US011980258B2

(12) United States Patent
Grabowski et al.

(10) Patent No.: US 11,980,258 B2
(45) Date of Patent: May 14, 2024

(54) MAGNETIC FASTENER SYSTEM

(71) Applicants: Steven Grabowski, Charleston, SC (US); Joseph A. DiCarlo, Chester, NH (US)

(72) Inventors: Steven Grabowski, Charleston, SC (US); Joseph A. DiCarlo, Chester, NH (US)

( * ) Notice: Subject to any disclaimer, the term of this patent is extended or adjusted under 35 U.S.C. 154(b) by 0 days.

(21) Appl. No.: 17/970,270

(22) Filed: Oct. 20, 2022

(65) Prior Publication Data

US 2023/0130028 A1 Apr. 27, 2023

Related U.S. Application Data

(60) Provisional application No. 63/306,431, filed on Feb. 3, 2022, provisional application No. 63/292,629, filed on Dec. 22, 2021, provisional application No. 63/271,016, filed on Oct. 22, 2021.

(51) Int. Cl.
*A44B 17/00* (2006.01)

(52) U.S. Cl.
CPC ..... *A44B 17/0005* (2013.01); *A44B 17/007* (2013.01); *A44B 17/0076* (2013.01); *A44B 17/0094* (2013.01)

(58) Field of Classification Search
CPC ..... A44B 17/0005; A44B 17/007; A44B 17/0076; A44B 17/0094; B63B 3/00; A44D 2203/00
See application file for complete search history.

(56) References Cited

U.S. PATENT DOCUMENTS

| | | | | |
|---|---|---|---|---|
| 3,111,737 A | | 11/1963 | Heil | 24/201 |
| 4,265,002 A | | 5/1981 | Hosken | 24/201 B |
| 5,142,746 A | * | 9/1992 | Morita | A45C 13/1069 24/303 |
| 5,317,789 A | * | 6/1994 | Levy | A44C 5/208 24/616 |
| D350,179 S | * | 8/1994 | Johnson | D21/794 |
| 5,473,799 A | * | 12/1995 | Aoki | E05C 19/16 24/66.1 |
| 5,572,773 A | * | 11/1996 | Bauer | A41F 1/002 24/303 |
| 5,983,464 A | | 11/1999 | Bauer | 24/303 |
| 6,182,336 B1 | * | 2/2001 | Bauer | A41F 1/002 24/66.1 |

(Continued)

*Primary Examiner* — David M Upchurch
(74) *Attorney, Agent, or Firm* — HAYES SOLOWAY P.C.

(57) ABSTRACT

A magnetic fastener system has a first fastener structure with a body with a first side and a second side. At least one of a male or female friction-snap fastener is positioned on the first side. A pocket is formed within the second side and a magnet is positioned therein. A recessed surface is formed in an interior of the pocket. A captive wall is formed around the recessed surface. The magnet is positioned between the first side and the recessed surface. A second fastener structure has a shape defined by an outer sidewall, wherein the shape of the outer sidewall substantially matches a shape defined by the captive wall, wherein second fastener structure is removably insertable into the pocket, and the first and second fastener structures are magnetically connectable. At least a third fastener structure is removably connectable to at least one of the male or the female friction-snap fastener.

20 Claims, 24 Drawing Sheets

(56) References Cited

U.S. PATENT DOCUMENTS

| | | | | |
|---|---|---|---|---|
| 6,226,842 | B1 | 5/2001 | Wong | 24/303 |
| 6,422,955 | B1 | 7/2002 | Lopez | 473/406 |
| 7,065,841 | B2 | 6/2006 | Sjoquist | 24/303 |
| 8,001,661 | B2 * | 8/2011 | Clark | A44C 17/0216 24/66.1 |
| 8,495,803 | B2 * | 7/2013 | Fiedler | H01F 7/0263 70/160 |
| 8,739,371 | B2 * | 6/2014 | Fiedler | A45C 13/1069 24/303 |
| 8,794,682 | B2 * | 8/2014 | Fiedler | A45C 13/1069 24/303 |
| 8,875,542 | B2 * | 11/2014 | Severs | A44C 17/0208 63/900 |
| 9,131,739 | B1 | 9/2015 | Sjoquist | A41F 1/002 |
| 9,140,279 | B2 * | 9/2015 | Frias | F16B 5/01 |
| 9,392,829 | B2 | 7/2016 | Manuello | A41F 1/002 |
| 9,572,386 | B1 | 2/2017 | Scheer et al. | A41F 1/002 |
| 9,717,293 | B2 | 8/2017 | Lim | A41F 1/002 |
| 10,165,811 | B2 * | 1/2019 | O'Leary | A44C 3/001 |
| 10,772,369 | B2 | 9/2020 | Horton | A41F 1/002 |
| 11,051,598 | B2 * | 7/2021 | Grunberger | A45C 13/1069 |
| 11,172,717 | B2 * | 11/2021 | Reiter | A44B 17/0088 |
| 2003/0024079 | A1 | 2/2003 | Morita | 24/303 |
| 2004/0200043 | A1 | 10/2004 | Wong et al. | 24/303 |
| 2008/0256978 | A1 * | 10/2008 | Chan | A44C 5/2076 63/3.1 |
| 2010/0263173 | A1 * | 10/2010 | Clarke | A41F 1/002 24/303 |
| 2010/0308605 | A1 * | 12/2010 | Fiedler | E05B 47/004 292/251.5 |
| 2011/0265289 | A1 * | 11/2011 | Wu | A44B 17/0064 24/303 |
| 2014/0189983 | A1 | 7/2014 | Maugham | A63B 57/0075 |
| 2016/0058147 | A1 | 3/2016 | Bemis | A45C 13/1069 |
| 2018/0325247 | A1 | 11/2018 | Vlassis et al. | A45F 5/02 |
| 2019/0246724 | A1 | 8/2019 | Adams | A41F 1/002 |

* cited by examiner

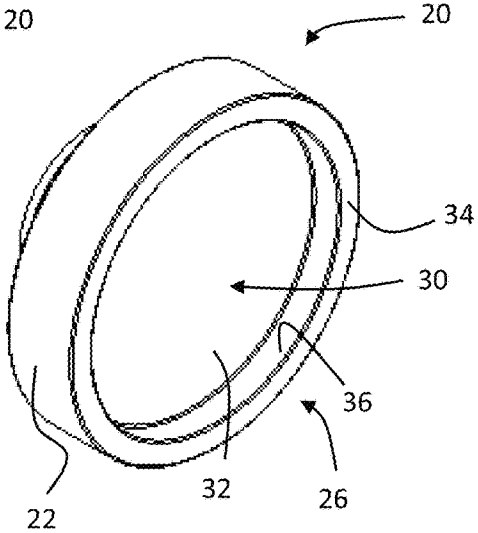
FIG. 2C
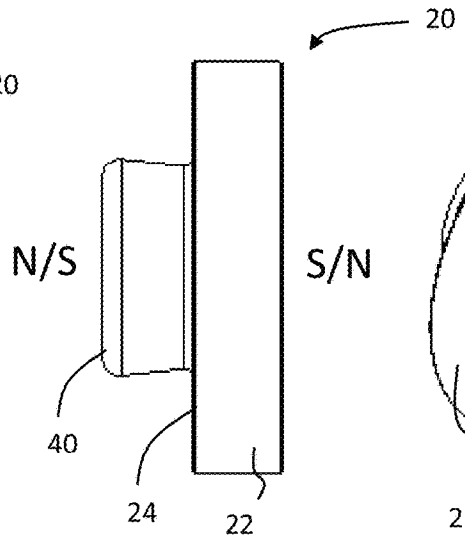
FIG. 2B
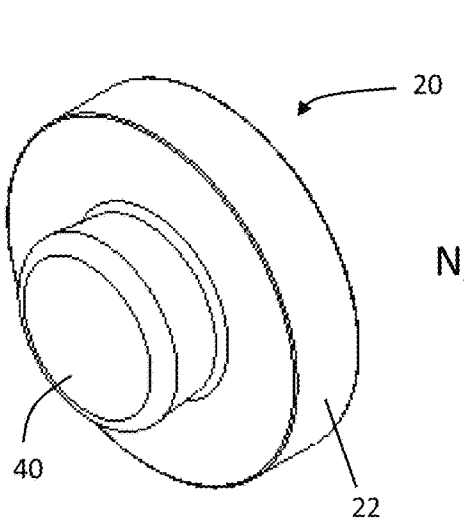
FIG. 2A
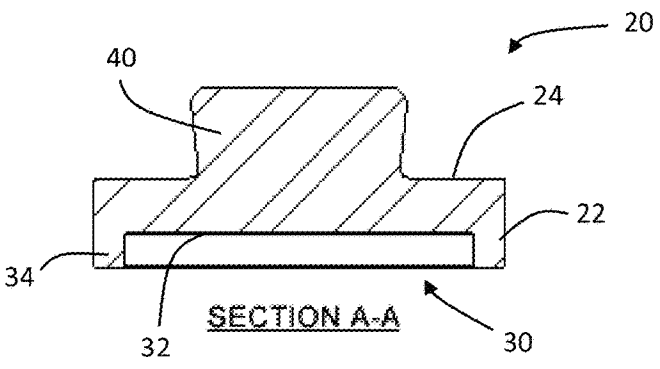
FIG. 2E
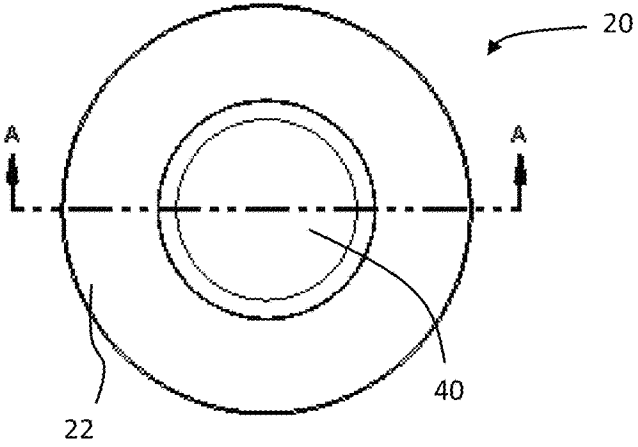
FIG. 2D
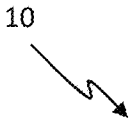

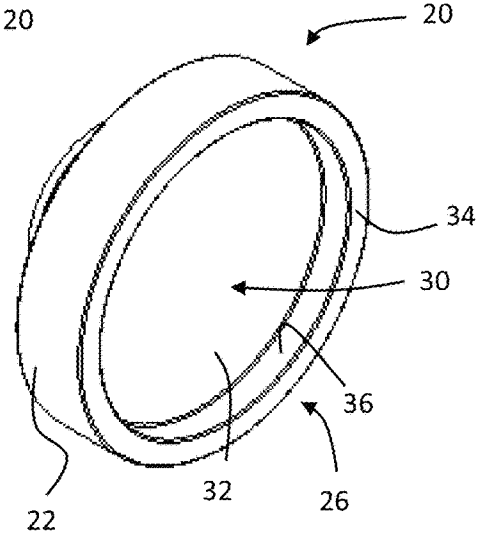
FIG. 3C
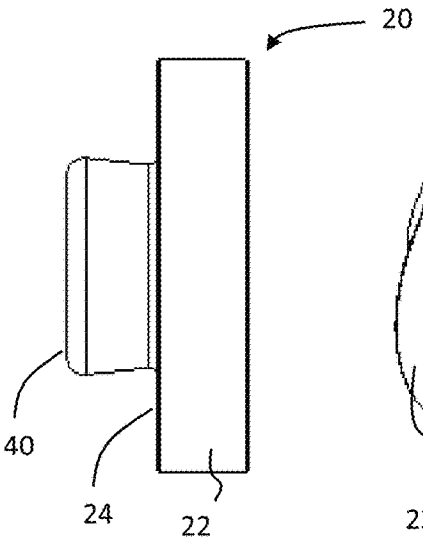
FIG. 3B
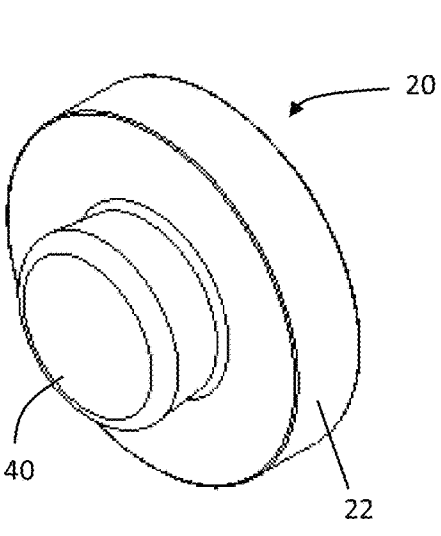
FIG. 3A
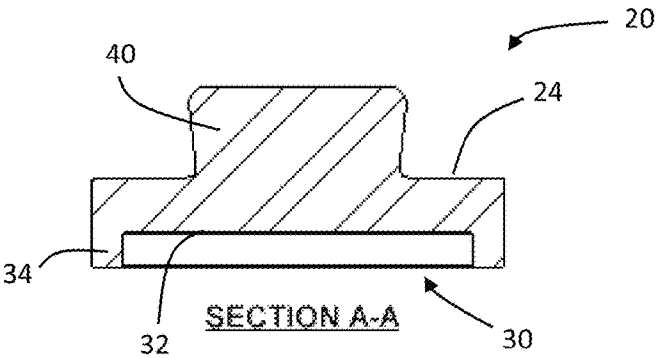
FIG. 3E
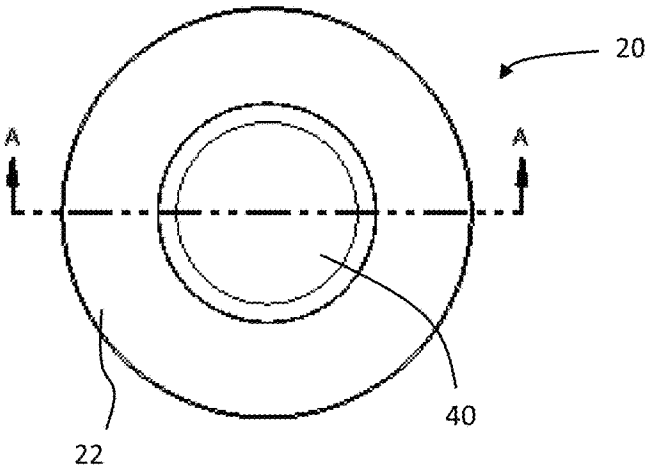
FIG. 3D
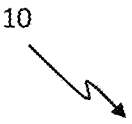

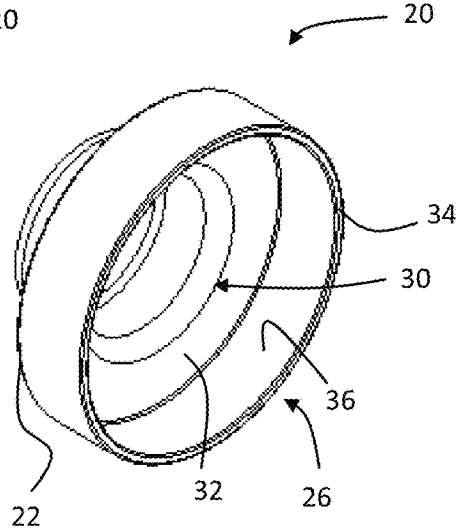
FIG. 4C
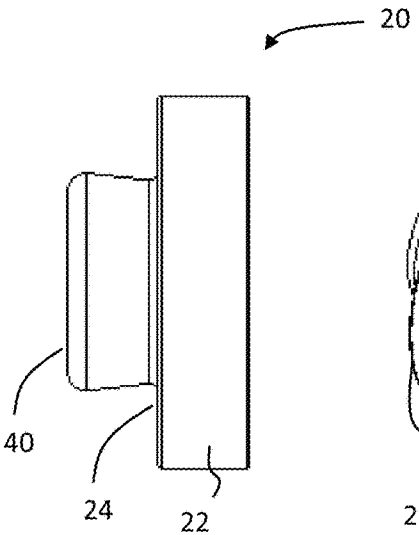
FIG. 4B
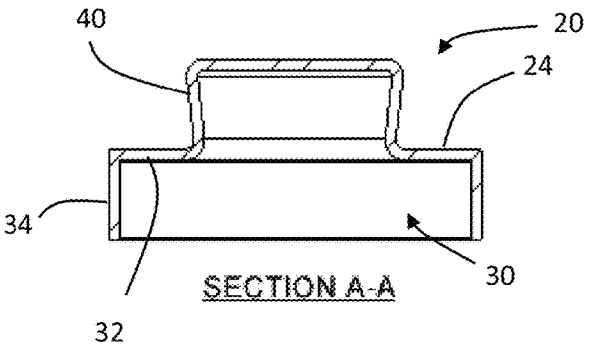
FIG. 4E
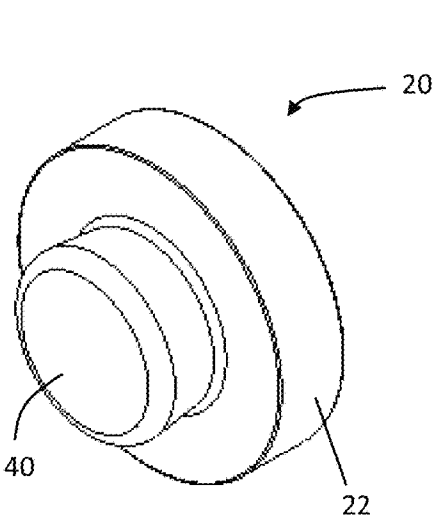
FIG. 4A
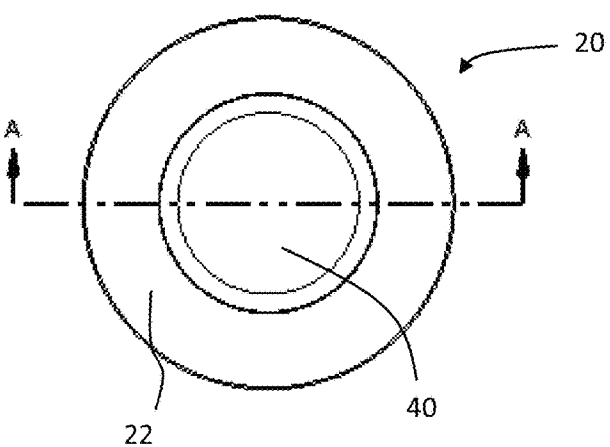
FIG. 4D
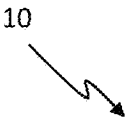

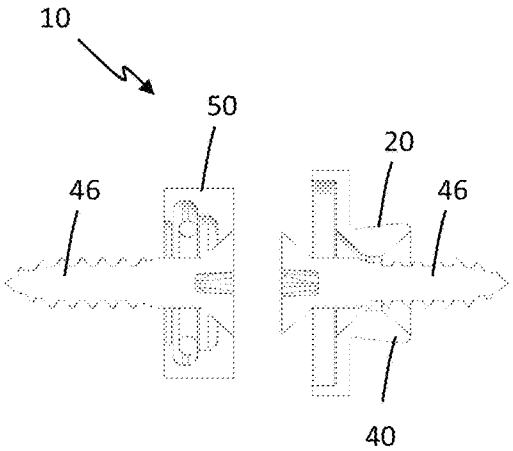
FIG. 12A
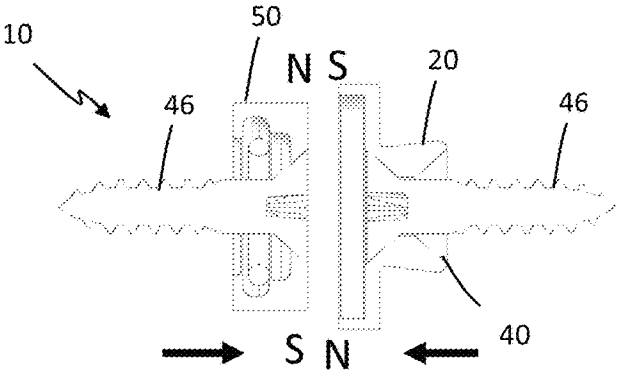
FIG. 12B
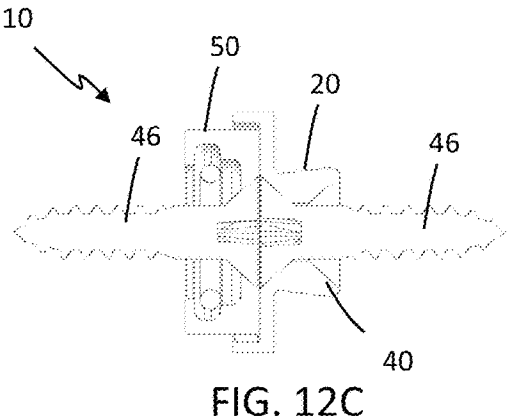
FIG. 12C
FIG. 12D
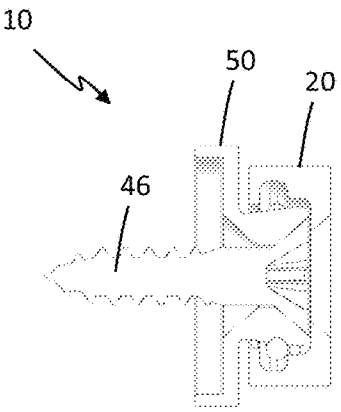
FIG. 12E
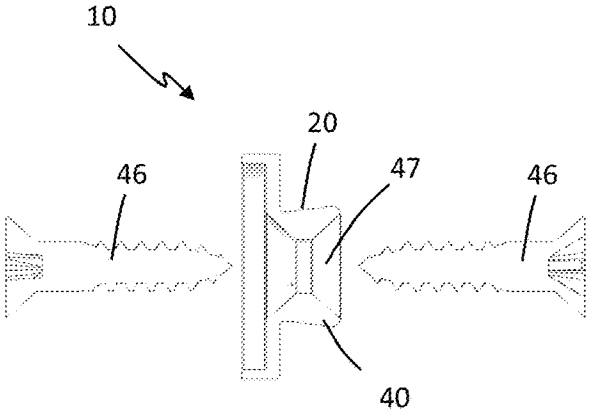
FIG. 12F

MAGNETIC FASTENER SYSTEM

CROSS REFERENCE TO RELATED APPLICATION

This application claims benefit of U.S. Provisional Application Ser. No. 63/292,629, entitled, "Magnetic Fastener System and Related Methods" filed Dec. 22, 2021, U.S. Provisional Application Ser. No. 63/271,016, entitled, "Magnetic Fastener System and Related Methods" filed Oct. 22, 2021, and U.S. Provisional Patent Application Ser. No. 63/306,431, entitled, "Magnetic Fastener System and Related Methods" filed Feb. 3, 2022, the disclosures of which are incorporated herein by reference.

FIELD OF THE DISCLOSURE

The present disclosure is generally related to fasteners and more particularly is related to a magnetic fastener system and related methods.

BACKGROUND OF THE DISCLOSURE

Fasteners are used in a variety of settings to connect two articles together. For instance, permanent fasteners, such as glues, epoxies, and the like, are often used to permanently secure two items together, such that the two items are usually not removable without damaging the items themselves. These permanent fasteners are often used with wood or plastic items which are adhesively bonded together. Semi-permanent fasteners, such as nuts and bolts, screws, nails, and the like, may be used to connect two items together such that they are joined for the long-term, but these fasteners can be removable, if needed, to allow the two items to be separated. For example, these fasteners may be used with infrastructure construction, the manufacturing of vehicles, and numerous other environments. Removable fasteners, such as buttons, zippers, hook and loop, and others, are fasteners which are intended to be removably separated and joined multiple times, thereby allowing two items to be connected and separated as the user desires. Removable fasteners may be found in many settings, such as within clothing, upholstery, and other products which use fabrics.

Within certain settings, removable fasteners may become damaged over time due to improper use, natural degradation, or environmental conditions. As a result, they become non-functional or difficult to operate. For instance, in one example in the maritime industry, many recreational boats have fabric-based cushions which are retained in place on the boat using conventional metal friction-snap buttons, e.g., where one part of the button (male or female) is attached to the boat seat and the other part of the button is attached to the fabric cushion, and the male and female portions removably connect together. Despite these buttons often being nickel plated or having another coating to ensure they survive aquatic and often saltwater environments, the snap buttons easily corrode and rust to the point where they cannot be easily separated or joined. This results in the inability to attach the cushions to the boat seat, or worse, tearing of the fabric on the cushions when a user attempts to remove the cushion from the boat seat.

Thus, a heretofore unaddressed need exists in the industry to address the aforementioned deficiencies and inadequacies.

SUMMARY OF THE DISCLOSURE

Embodiments of the present disclosure provide a magnetic fastener system and related methods. Briefly described, in architecture, one exemplary embodiment of the system, among others, can be implemented as follows. A first fastener structure has a body with a first side and a second side, wherein the first side is opposite the second side. At least one of a male friction-snap fastener or female friction-snap fastener is positioned on the first side. A pocket is formed within the second side of the body. A magnet is positioned within the pocket. A recessed surface is formed in an interior of the pocket, wherein a captive wall is formed around the recessed surface, wherein the magnet is positioned at least partially between the first side and the recessed surface. A second fastener structure having a shape defined by an outer sidewall, wherein the shape of the outer sidewall substantially matches a shape defined by the captive wall, wherein second fastener structure is removably insertable into the pocket, and wherein the first and second fastener structures are magnetically connectable. At least a third fastener structure is removably connectable to the at least one of the male friction-snap fastener or the female friction-snap fastener positioned on the first side of the first fastener structure.

The present disclosure can also be viewed as providing a magnetic fastener system and related methods. Briefly described, in architecture, one exemplary embodiment of the system, among others, can be implemented as follows. A first fastener structure has a body with a first side and a second side, wherein the first side is opposite the second side. At least one of a male friction-snap fastener or female friction-snap fastener is positioned on the first side. A pocket is formed within the second side of the body. A magnet is positioned within the pocket. A recessed surface is formed in an interior of the pocket, wherein a captive wall is formed around the recessed surface, wherein the magnet is positioned at least partially between the first side and the recessed surface. A second fastener structure having a shape defined by an outer sidewall, wherein the shape of the outer sidewall substantially matches a shape defined by the captive wall, wherein second fastener structure is removably insertable into the pocket, and wherein the first and second fastener structures are magnetically connectable. At least a third fastener structure is removably connectable to the at least one of the male friction-snap fastener or the female friction-snap fastener positioned on the first side of the first fastener structure. At least two securable articles are provided, wherein a first securable article of the at least two securable articles is positioned in contact with the third fastener, and wherein a second securable article of the at least two securable articles is positioned in contact with one of the first fastener structure or the second fastener structure, wherein the first fastener structure, the second fastener structure, and the third fastener structure form a magnetically removable connection between the first and second securable articles.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 2A-2E are various illustrations of a first fastener structure for use with a magnetic fastening system, in accordance with exemplary embodiments of the present disclosure.

FIGS. 3A-3E are various illustrations of a first fastener structure for use with a magnetic fastening system, in accordance with exemplary embodiments of the present disclosure.

FIGS. 4A-4E are various illustrations of a first fastener structure for use with a magnetic fastening system, in accordance with exemplary embodiments of the present disclosure.

FIGS. 12A-12F are various illustrations of a magnetic fastening system, in accordance with exemplary embodiments of the present disclosure.

DETAILED DESCRIPTION

To improve over the shortcomings described in the Background, the present disclosure is directed to a magnetic fastening system which can be used with conventional metal friction-snap buttons and/or in place of all or a portion of conventional metal friction-snap buttons, such that damaged, degraded, or otherwise unusable buttons can be effectively replaced or retrofitted with a magnetic connection, thereby allowing for the button to be used without damage to itself or other articles.

Figures 1A, 1B:
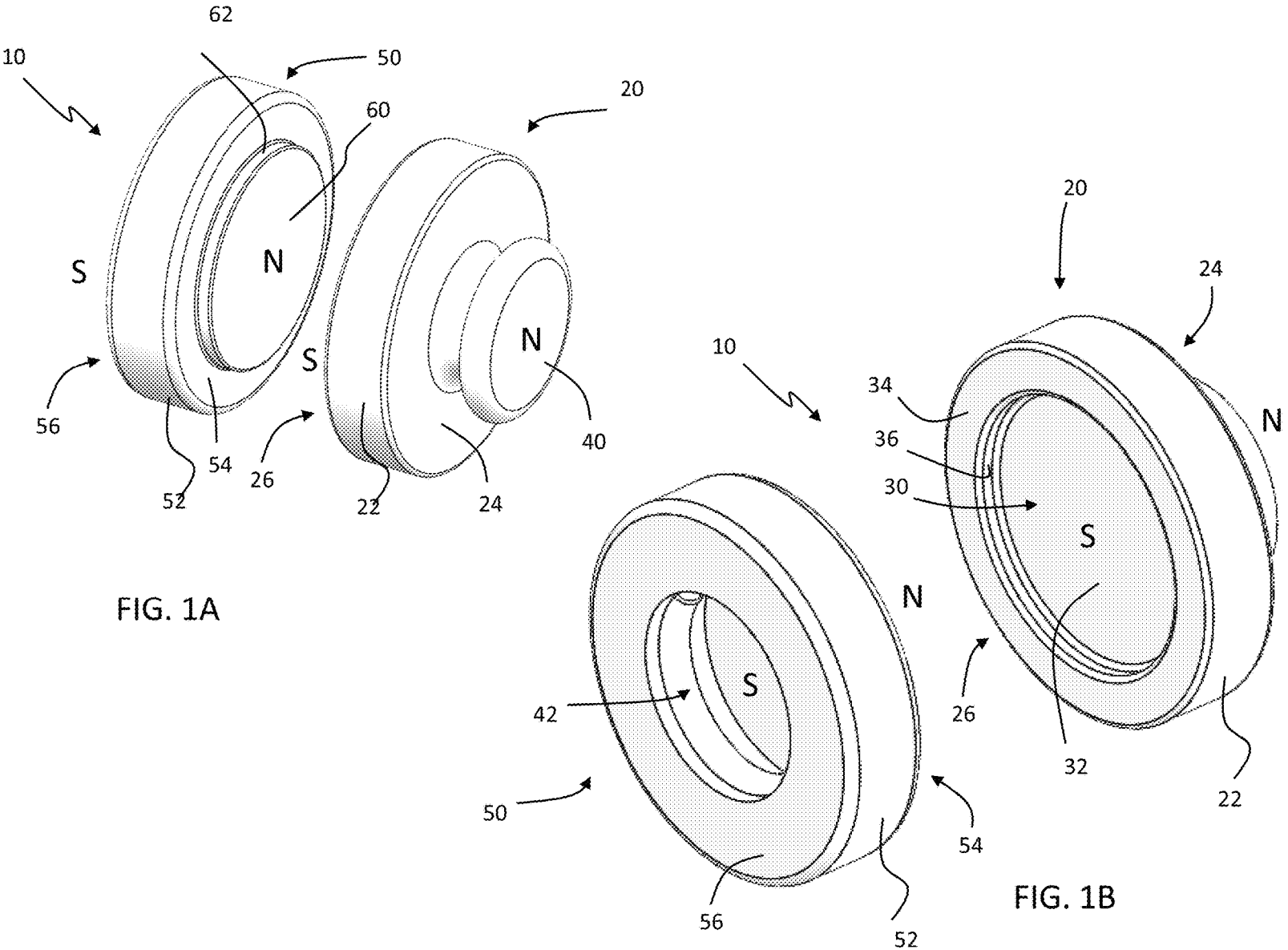
FIGS. 1A-IC are exploded-view illustrations of a magnetic fastening system, in accordance with exemplary embodiments of the present disclosure.
Figure 1D:
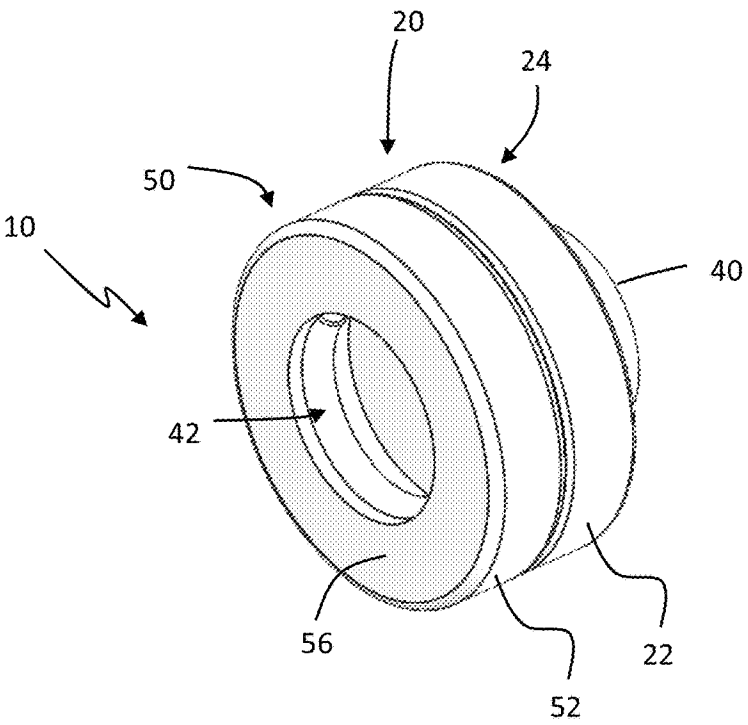
FIG. 1D is an illustration of the magnetic fastening system of FIGS. 1A-1C, in accordance with exemplary embodiments of the present disclosure.

FIGS. 1A-IC are exploded-view illustrations of a magnetic fastening system 10, in accordance with exemplary embodiments of the present disclosure. FIG. 1D is an illustration of the magnetic fastening system 10 of FIGS. 1A-IC, in accordance with exemplary embodiments of the present disclosure. With reference to FIGS. 1A-1D, the magnetic fastening system 10, which may be referred to herein simply as 'system 10' includes a first fastener structure 20 which has a body 22 with a first side 24 and a second side 26. As shown in the figures, the body 22 may be formed with a disc shape or similar shape which is flattened, where the first side 24 is opposite the second side 26 on the body 22. At least one of a male friction-snap fastener 40 or female friction-snap fastener (not shown in FIGS. 1A-1D) is positioned on the first side 24, such that the friction-snap fastener 40 extends from the first side 24. This friction-snap fastener 40 may be sized to be used with conventional metal friction-snap fasteners or push buttons, e.g., where the friction-snap fastener 40, when male, can be received within a female receptacle of a conventional friction-snap fastener and remain in place.

On the second side 26 of the body 22 is a pocket 30 which is formed as s counterbore within the body 22 which extends inward from a plane of a surface on the second side 26. As shown, the pocket has a recessed surface 32 or floor of the pocket 30 with a captive wall 34 formed around the recessed surface 32 such that all or a portion of the recessed surface 32 is circumferentially surrounded by the captive wall 34. The captive wall 34 may have an interior sidewall surface 36 which faces inwards towards a center point of the body 22, where the interior sidewall surface 36 may intersect at an annular corner junction with the recessed surface 32. Various other shapes, contours, features, or structures may be included or omitted from the pocket 30, such as is shown in other figures of this disclosure, all of which are within the scope of the present disclosure.

FIGS. 1A-1D also illustrate a second fastener structure 50 which magnetically mates with the first fastener structure 20. As shown, the second fastener structure 50 has a first side 54 and a second side 56 which are positioned substantially opposite one another on the body 52 of the second fastener structure 50. Along the first side 54, a central protrusion 60 extends from the first side 54 in a direction away from the surface of the first side 54. The central protrusion 60 has a shape that is defined by an outer sidewall 62 thereof, which in FIGS. 1A-1D is illustrated as being circular, however other shapes may be used. The central protrusion 60 may extend away from the surface of the first side 54 any distance, the specific distance of which is selected to correspond to the pocket 30 depth on the first fastener structure 20.

Figure 1C:
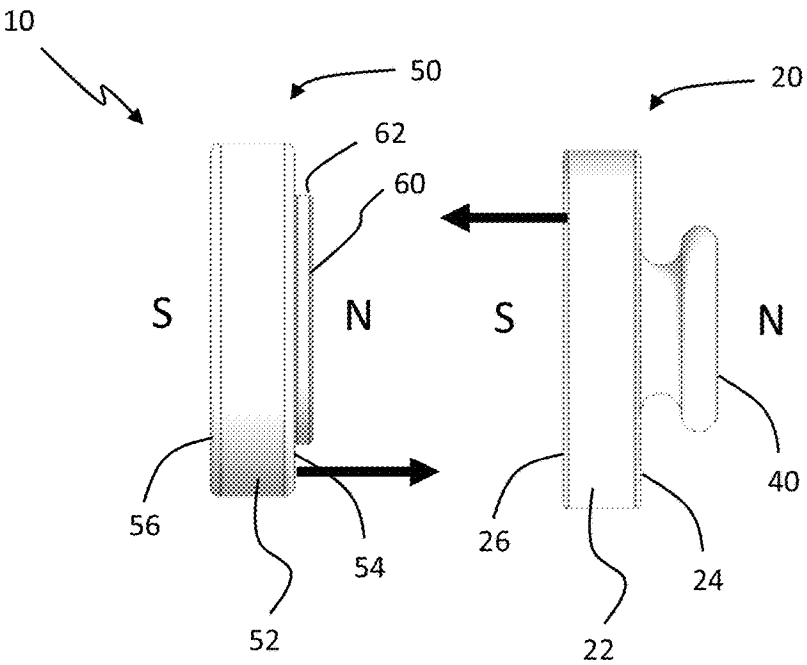
Figure 5C:
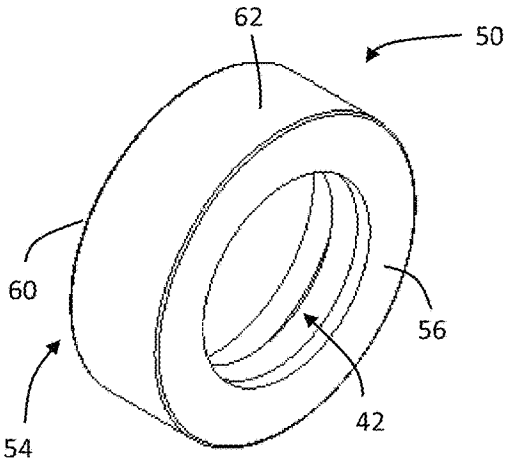
FIGS. 5A-5E are various illustrations of a second fastener structure for use with a magnetic fastening system, in accordance with exemplary embodiments of the present disclosure.
Figure 5B:
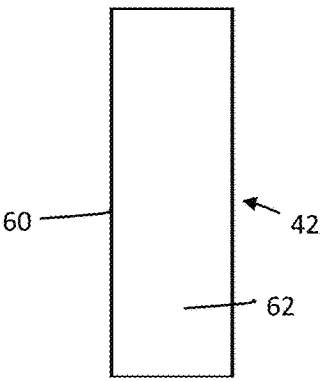
Figure 5A:
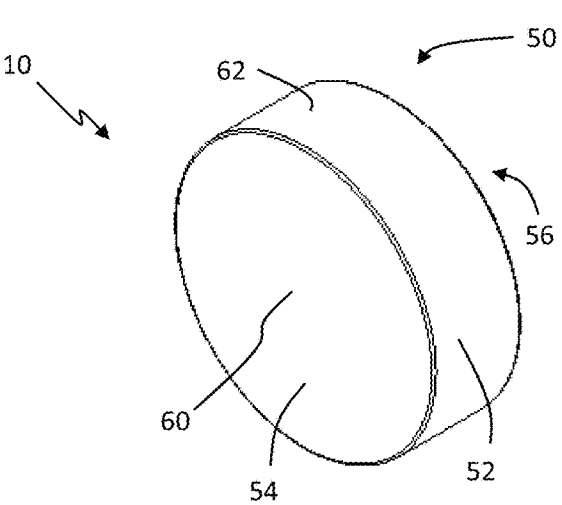
Figure 5E:
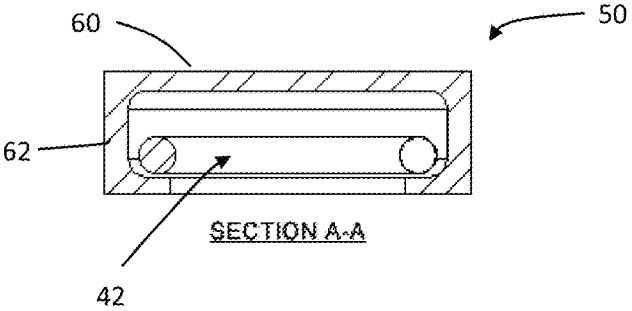
Figure 5D:
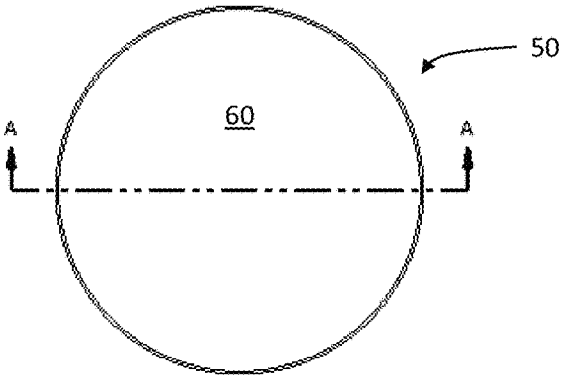

In use, the first and second fastener structures 20, 50 are mateable with the central protrusion 60 of the second fastener structure 50 being fully or partially insertable into the pocket 30 of the first fastener structure 20, which is best depicted in FIGS. 1C-1D. To ensure proper mating of these structures, the central protrusion 60 may have a footprint or general shape which fully or substantially matches a shape defined by the captive wall 34 of the pocket 30 and have an outer diameter which is sized slightly smaller (toleranced) than the inner diameter of the pocket 30, such that the central protrusion 60 fits within the pocket 30 easily. Preferably, the tolerance of the central protrusion 60 to the pocket 30 allows for easy insertion and removal of the central protrusion 60 but is sufficiently small enough to limit undesired radial movement of the central protrusion 60 within the pocket 30, e.g., side wiggle.

One or both of the first and second fastener structures 20, 50 are magnetically energized, whereby one or both of these structures emits a magnetic field which attracts or repels a ferromagnetic material. In FIGS. 1A-ID, both the first and second fastener structures 20, 50 are illustrated as being magnetic, whereby the north pole and south pole of the magnetic field emitted is labeled, but it is also possible to have only one of the first and second fastener structures 20, 50 be magnetically energized while the other of the first and second fastener structures 20, 50 is merely a ferromagnetic material. The use of two magnetically energized fasteners versus only one magnetically energized fastener may allow for stronger and weaker magnetic attraction forces, respectively, between the first and second fastener structures 20, 50.

The magnetic force between the first and second fastener structures 20, 50 may be selected based on the intended use of the magnetic fastener system 10. For instance, magnetic force may be sufficient to prevent inadvertent separation between the first and second fastener structures 20, 50, but it may be limited enough to ensure that a user can separate the two structures when desired. While the specific magnetic force may vary, in one example the first and second fastener structures 20, 50 may have a magnetic force which is substantially 1 lb., 2 lbs., 3 lbs., 5 lbs., 10 lbs., or more, or any other increment therebetween. More specifically, when the system 10 is intended to be used in harsh environments such as on a boat in the ocean where the system 10 will be subjected to G-forces from fast boat operating, wind, and other direct forces, it may be desirable to have a magnetic attraction force which is high. In contrast, if the system 10 is used in stable, calm environments, small magnetic attraction forces can be used.

In use, as the central protrusion 60 of the second fastener structure 50 is moved towards the pocket 30 of the first fastener structure 50, the magnetic force between the structures biases the two structures together. The central protrusion 60 passes by the exterior of the captive wall 34 and moves along the sidewall 36 of the captive wall 34 until the exterior planar surface of the central protrusion 60 contacts the recessed floor 32 of the pocket 30, or until the first side 54 of the second fastener structure 50 makes contact with the second side 26 of the first fastener structure 20. Preferably, the distance the central protrusion 60 extends from the first side 54 is selected to substantially match the depth of the pocket 30, such that when the exterior planar surface of the central protrusion 60 contacts the recessed floor 32 of the pocket 30, the first side 54 of the second fastener structure 50 is in contact with the second side 26 of the first fastener structure 20. The captive wall 34 not only ensures that the central protrusion 60 can magnetically mate properly with the recessed floor 32, but importantly, the captive wall 34 prevents the central protrusion 60 from moving or sliding in a lateral or radial direction away from magnetic force of the recessed floor 32. Without the captive wall 34, the magnetic connection between the central protrusion 60 and the recessed floor 32 may be substantially weakened if the two structures move lateral to one another such that the magnetic field there between is weakened and can no longer hold the two structures together.

While the first fastener structure 20 includes the friction-snap fastener 40 on its first side 24, the system 10 may also include an additional friction-snap fastener 42 located on the second side 56 of the second fastener structure 50. As shown in FIG. 1B, this additional friction-snap fastener 42 may be a female version, such that it can receive the male end of a conventional metal friction-snap fastener. The female friction-snap fastener may operate as is known conventionally, such as with a biased ring which is positioned within an annular groove within a cavity of the female friction-snap fastener, whereby when the male friction-snap fastener is pushed into the cavity, it slightly biases the ring outwards until the ring moves beyond a lip of the male friction-snap fastener, at which point the ring moves inward and holds the male friction-snap fastener within the cavity. The friction-snap fasteners 40, 42 may be used to connect with other fastener structures (not shown), such as existing metal friction-snap fasteners on various items or structures.

For example, while the system 10 may have uses in many industries and with many products, it may be particularly beneficial within the boating industry. As discussed in the Background, boats typically have seats formed from fiberglass, wood, plastics, or metal, which have cushions that removably attached to those seats. The attachment between the cushions and the seats with the conventional metal friction-snap fasteners is prone to having problems as the metal fasteners rust, corrode, or degrade, which is very common in saltwater environments, and the result is often a user trying to remove a cushion with such force that the cushion fabric rips. Replacing fasteners on the boats and cushions or replacing the cushions themselves is expensive. The system 10 may provide a solution to the user, where the fastener structures 20, 50 of the system 10 can be attached to the existing metal friction-snap fasteners on the boat and cushion, and the magnetic attraction between the first and second fastener structures 20, 50 holds the cushion to the seats. When the user wishes to remove the cushions, he or she can simply pull on the cushion enough until he or she overcomes the magnetic force between the first and second fastener structures 20, 50, thereby releasing the cushion from the seat. The first and second fastener structures 20, 50 can remain attached to the boat and cushion, respectively, via the friction-snap fasteners 40, 42, such that the rusted, corroded, or otherwise damaged buttons on the boat or cushion are no longer an impediment to removing the cushions.

It is noted that while FIGS. 1A-1D depict a male friction-snap fastener 40 positioned on the first fastener structure 20 having the pocket 30 and the female friction-snap fastener 42 positioned on the second fastener structure 50 having the protrusion 60, either fastener structure 20, 50 can have either the male or female friction-snap fastener on it, as may depend on the design and intended use of the system 10. Additionally, the first and second fastener structures may be provided with a non-rust and/or anti corrosion material, such as nickel plating, galvanization, chrome, or similar coating.

Carrying forward the concept described relative to FIGS. 1A-1D, FIG. 2A through FIG. 4E illustrate different examples of the first fastener structure 20, while FIGS. 5A-5E illustrate a different example of the second fastener structure 50.

FIGS. 2A-2E are various illustrations of a first fastener structure 20 for use with a magnetic fastening system 10, in accordance with exemplary embodiments of the present disclosure. The first fastener structure 20 of the system 10 of FIGS. 2A-2E is substantially similar to the first fastener structure 20 described relative to FIGS. 1A-1D, as the first fastener structure 20 has a body 22 with a first side 24 and a second side 26, at least one of a male friction-snap fastener 40 or female friction-snap fastener (not shown) positioned on the first side 24, and a pocket 30 which extends inward from a plane of a surface on the second side 26, where the pocket 30 has a recessed surface 32 and a captive wall 34 with an interior sidewall surface 36. As shown in FIG. 2B, the first fastener structure 20 is magnetically energized, whereby one side has a north pole and an opposing side has a south pole, but the specific arrangement of north or south on the fastener structure 20 can vary. The first fastener structure 20 of FIGS. 2A-2E may be formed as a substantially solid metal material.

FIGS. 3A-3E are various illustrations of a first fastener structure 20 for use with a magnetic fastening system 10, in accordance with exemplary embodiments of the present disclosure. The first fastener structure 20 of the system 10 of FIGS. 3A-3E is substantially similar to the first fastener structure 20 described relative to FIGS. 1A-2E, as the first fastener structure 20 has a body 22 with a first side 24 and a second side 26, at least one of a male friction-snap fastener 40 or female friction-snap fastener (not shown) positioned on the first side 24, and a pocket 30 which extends inward from a plane of a surface on the second side 26, where the pocket 30 has a recessed surface 32 and a captive wall 34 with an interior sidewall surface 36. Unlike the first fastener structure in FIGS. 2A-2E which is magnetized, the first fastener structure 20 of FIGS. 3A-3E is not magnetically energized. Rather, it is constructed from a metal material, steel or another metal or compound thereof, such that it is capable of interacting with the magnetic field of a second fastener structure (not shown) which is magnetically energized.

FIGS. 4A-4E are various illustrations of a first fastener structure 20 for use with a magnetic fastening system 10, in accordance with exemplary embodiments of the present disclosure. The first fastener structure 20 of the system 10 of FIGS. 4A-4E is substantially similar to the first fastener structure 20 described relative to FIGS. 1A-3E, as the first fastener structure 20 has a body 22 with a first side 24 and a second side 26, at least one of a male friction-snap fastener 40 or female friction-snap fastener (not shown) positioned on the first side 24, and a pocket 30 which extends inward from a plane of a surface on the second side 26, where the pocket 30 has a recessed surface 32 and a captive wall 34 with an interior sidewall surface 36. However, unlike the first fastener structure in FIGS. 2A-2E which is magnetized, and both the first fastener structure 20 in FIGS. 2A-3E which are solid, the first fastener structure 20 of FIGS. 4A-4E is not magnetically energized and is not formed from a solid material. Rather, it is constructed from a sheet metal material which is stamped or otherwise formed into the depicted shape. Forming the first fastener structure 20 from a stamped sheet metal material may reduce manufacturing and machining costs and improve the efficiency of manufacturing overall.

As shown in FIGS. 4A-4E, when the first fastener structure 20 is made from sheet metal, the recessed floor 32 of the pocket 30 may have varying depths, e.g., which correspond to an opposing surface of the first side 24 and the opposing surface of the male friction-snap fastener 40. When the protrusion of the second fastener structure is placed within the pocket 30, only a portion of that protrusion's planar forward surface may mate with the annular portion of the recessed floor 32. Additionally, it is noted that the first fastener structure 20 being formed from sheet metal may be capable of interacting with the magnetic field of a second fastener structure (not shown) which is magnetically energized.

FIGS. 5A-5E are various illustrations of the second fastener structure 50 for use with a magnetic fastening system 10, in accordance with exemplary embodiments of the present disclosure. The second fastener structure 50 of the system 10 of FIGS. 5A-5E is substantially similar to the second fastener structure 50 described relative to FIGS. 1A-1D, in that, it has a first side 54 and a second side 56 which are positioned substantially opposite one another on the body 52 and has a friction-snap fastener 42 positioned on the second side 56. However, while the second fastener structure 50 in the previous design has a protrusion 60 extending from a central region of the first side 54, the second fastener structure 50 of FIGS. 5A-5E has a protrusion 60 which substantially matches the overall footprint of the second fastener structure 50. With this design, the protrusion 60 is able to be positioned within the pocket 30 of the first fastener structure 20 of any of the designs discussed relative to FIGS. 1A-4E, and magnetically mate with the recessed surface 32 of that first fastener structure 20. When mating with a first fastener structure 20 which is magnetically energized, the second fastener structure 50 may or may not be magnetically energized as well. However, when mating with a first fastener structure which is not magnetically energized, such as that discussed relative to FIGS. 3A-3E, the second fastener structure 50 is magnetically energized.

Figure 6C:
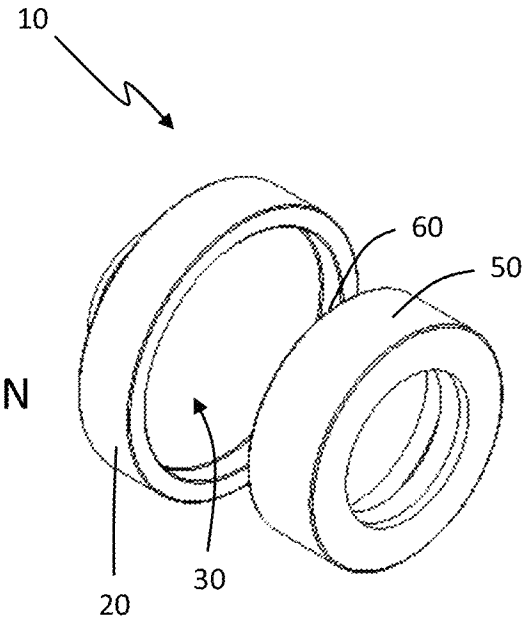
FIGS. 6A-6C are exploded-view illustrations of a magnetic fastening system, in accordance with exemplary embodiments of the present disclosure.
Figure 6B:
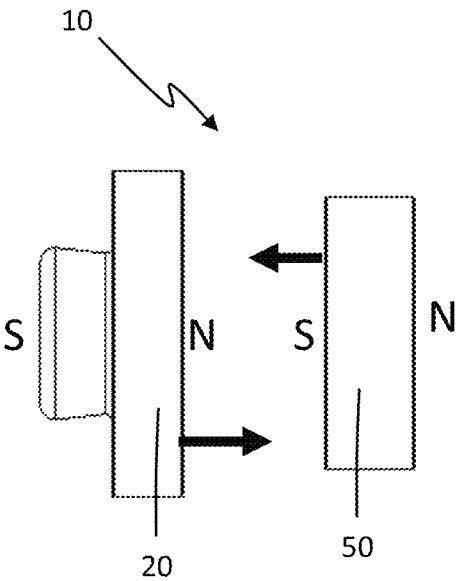
Figure 6A:
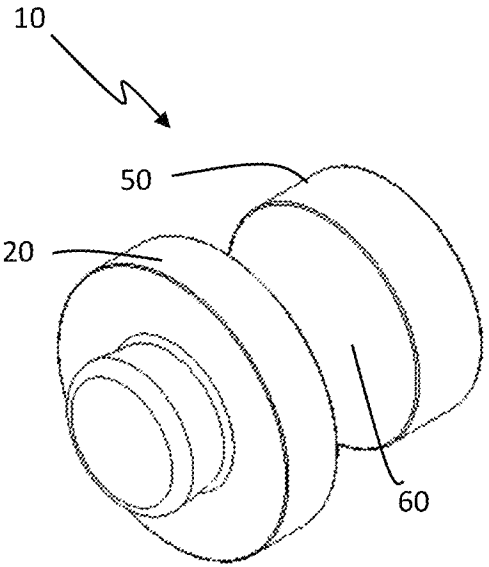
Figure 7A:
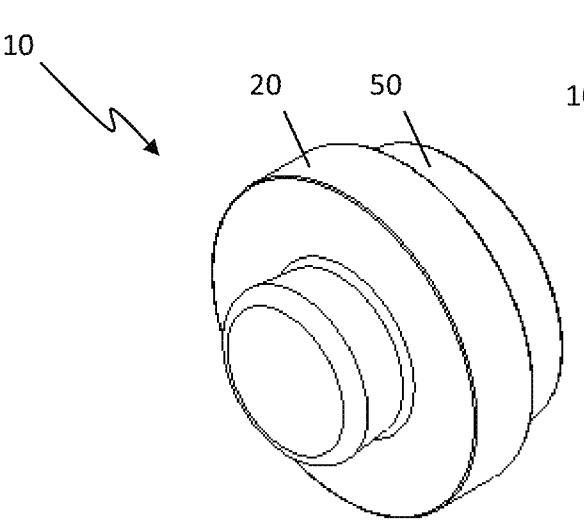
FIGS. 7A-7E are various illustrations of a magnetic fastening system, in accordance with exemplary embodiments of the present disclosure.
Figure 7B:
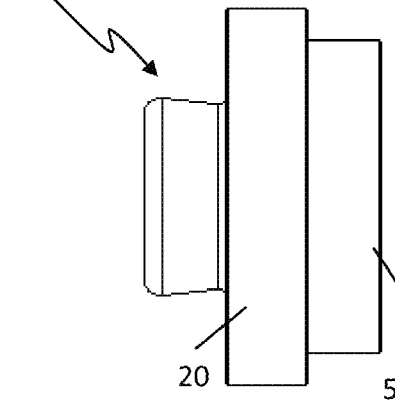
Figure 7C:
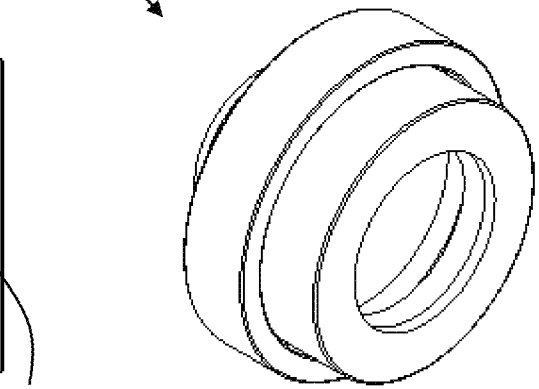
Figure 7D:
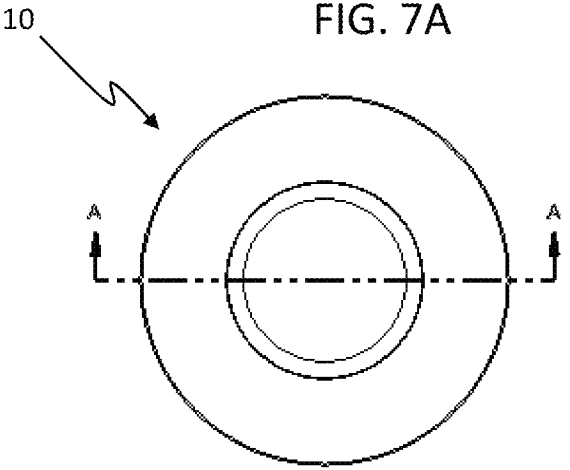
Figure 7E:
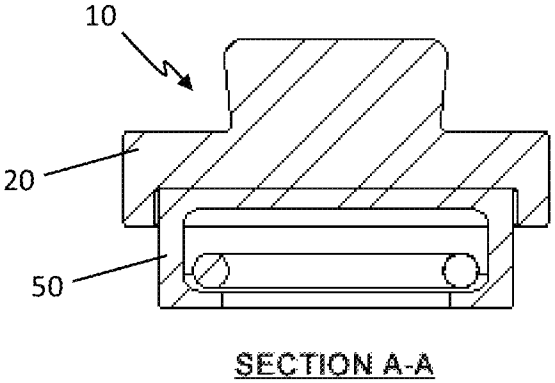

FIGS. 6A-6C are exploded-view illustrations of a magnetic fastening system 10, in accordance with exemplary embodiments of the present disclosure. In particular, FIGS. 6A-6C illustrate an example of the system 10 where the first fastener structure 20 of FIGS. 2A-2E and the second fastener structure 50 of FIGS. 5A-5E are positioned in alignment for connection together and with magnetic forces. As shown, the first fastener structure 20 is positioned with the pocket 30 open to the protrusion 60 of the second fastener structure 20, such that the magnetic forces between the two structures bias the protrusion 60 into the pocket 30, as previously described. FIGS. 7A-7E are illustrations of the magnetic fastening system 10, in accordance with exemplary embodiments of the present disclosure, and in particular, they depict the system 10 with the first and second fastener structures 20, 50 connected together.

Figure 8D:
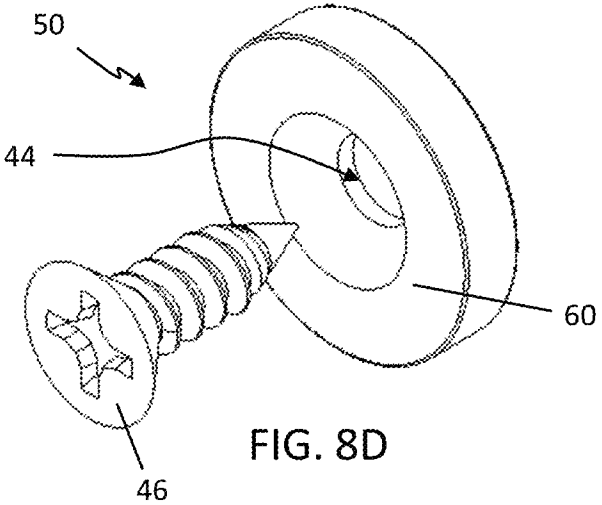
FIGS. 8A-8D are various illustrations of a magnetic fastener for use with a magnetic fastening system and the magnetic fastening system itself, in accordance with exemplary embodiments of the present disclosure.
Figure 8C:
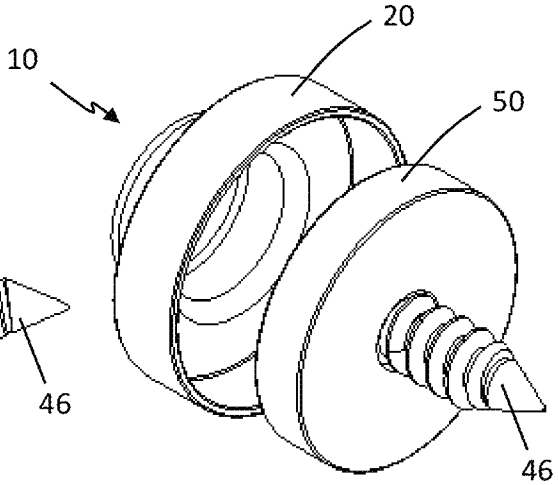
Figure 8B:
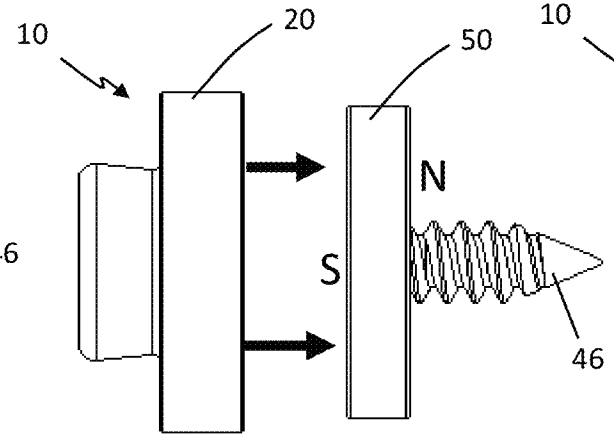
Figure 8A:
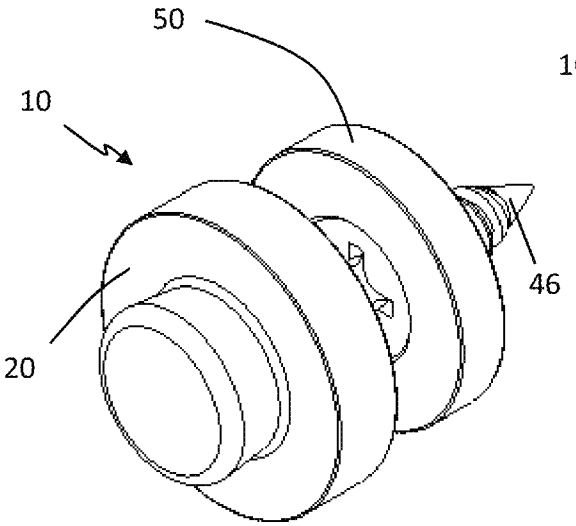

FIG. 8A illustrates a similar design of the second fastener structure 50 to what is described relative to FIGS. 5A-5E, however, unlike the second fastener structure 50 of FIGS. 5A-5E which has a friction-snap fastener 42 on the second side 56 thereof, the second fastener structure 50 of FIG. 8A has a central aperture 44 through which a threaded fastener 46, such as a screw or bolt, can be placed. With this design, the second fastener structure 50 can be mounted directly to a structure when a conventional friction-snap fastener isn't present. For instance, if the friction-snap fastener on a boat seat is degraded so severely that it cannot function, a user may remove it from the boat seat and in its place attach the second fastener structure 50 with a fastener 46 positioned through the central aperture 42. The user may then attach the first fastener structure 20 to the second fastener structure 50 through magnetic force.

Figure 9A:
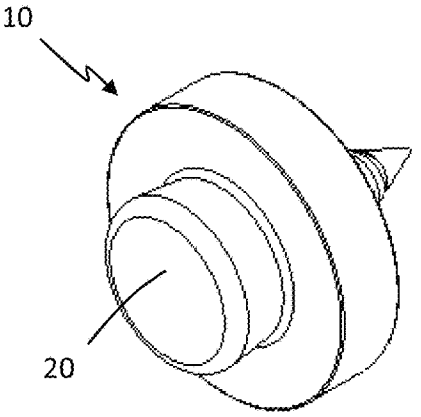
FIGS. 9A-9E are various illustrations of a magnetic fastening system, in accordance with exemplary embodiments of the present disclosure.
Figure 9B:
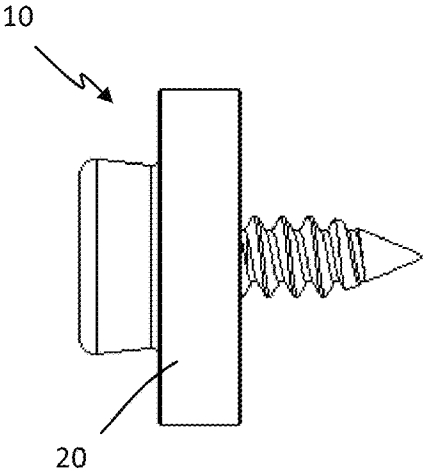
Figure 9C:
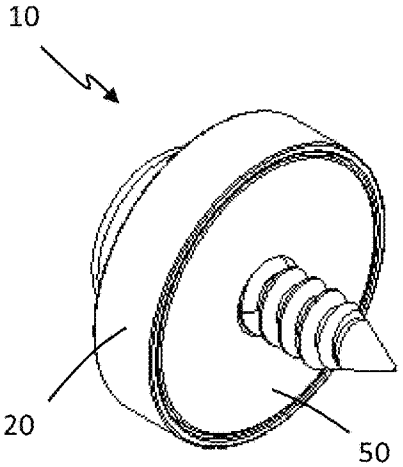
Figure 9D:
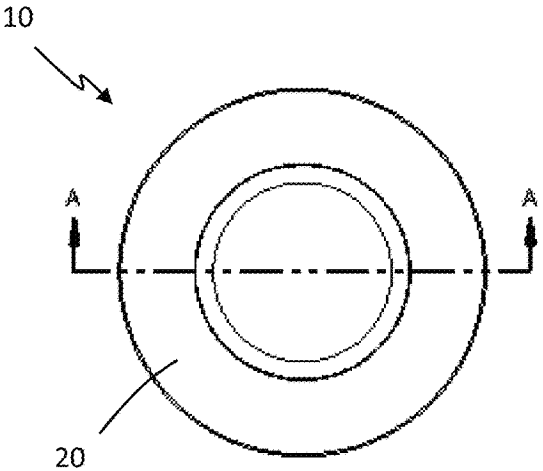
Figure 9E:
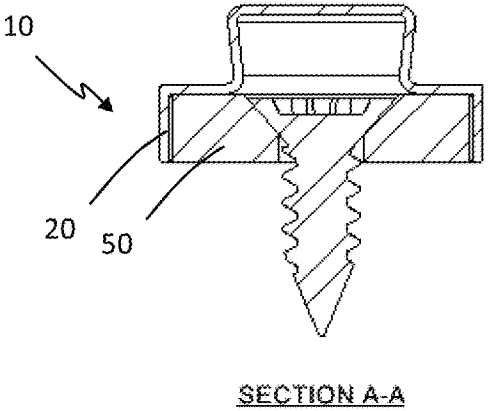

FIGS. 8B-8D are various illustrations of the magnetic fastening system, in accordance with exemplary embodiments of the present disclosure, and FIGS. 9A-9E are illustrations of a magnetic fastening system, in accordance with exemplary embodiments of the present disclosure. In particular, FIGS. 8B-8D illustrate the first and second fastener structure 20, 50 in exploded view but in alignment for connection. FIG. 8B, in particular, illustrates the magnetic force for when the second fastener structure 50 alone is magnetized. FIGS. 9A-9E illustrate the first and second fastener structures 20, 50 connected together. It is noted that FIGS. 8C and 9E illustrate the first fastener structure 20 as the sheet metal stamped unit described relative to FIGS. 4A-4E.

Figure 10B:
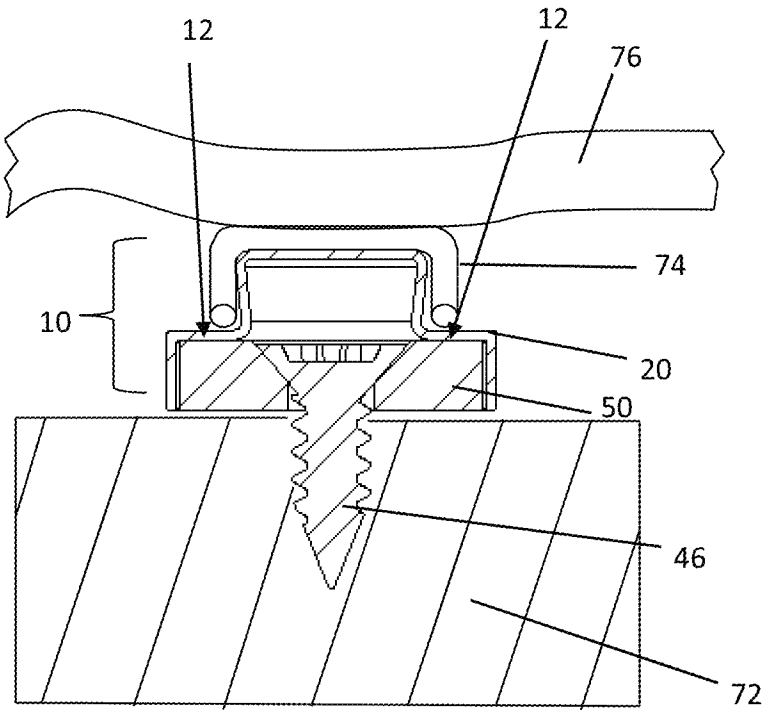
FIGS. 10A-10B are various illustrations of a magnetic fastening system, in accordance with exemplary embodiments of the present disclosure.
Figure 10A:
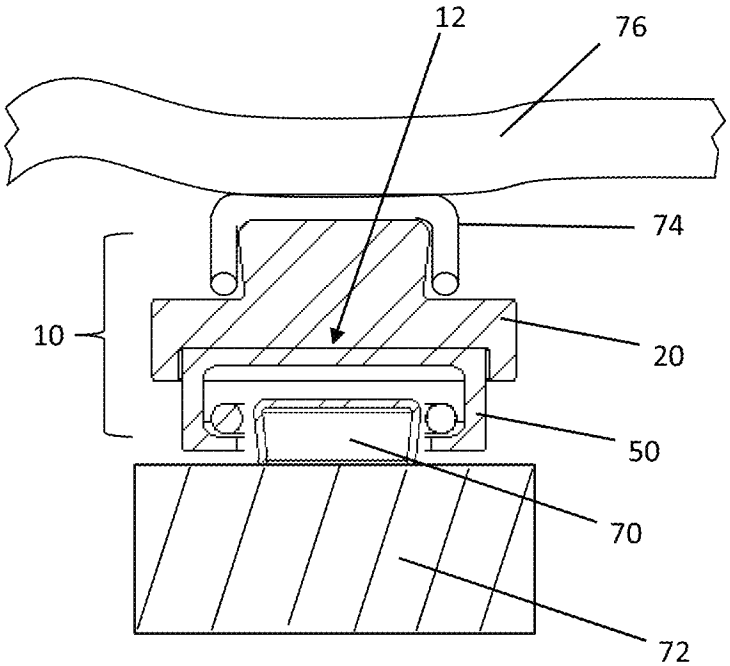

FIGS. 10A-10B are illustrations of a magnetic fastening system, in accordance with exemplary embodiments of the present disclosure, and in particular, these figures illustrate the system 10 in use with conventional friction-snap fasteners. As shown in FIG. 10A, the system 10 having the first and second fastener structures 20, 50 is connected between a first conventional friction-snap fastener 70 which may be attached, for example, to a structure 72 such as a boat seat, and a second conventional friction-snap fastener 74 which is connected to another structure 76, such as the fabric of a pillow for the boat seat. As can be seen, the system 10 fully interfaces with the existing conventional friction-snap fasteners 70, 74 and still allows removal of the structures 72, 76 from one another by separation of the magnetic connection 12 formed between the first and second fastener structure 20, 50. FIG. 10B illustrates a similar example, but instead of a conventional friction-snap fastener 70 positioned on the structure 72, the second fastener structure 50 is connected directly to the structure 72 with the threaded fastener 46. This arrangement could be used in a situation where the conventional fastener 70 attached to the structure 72 is too deteriorated to use, such that it is removed and the second fastener structure 50 is mounted to the structure 72.

Figure 11A:
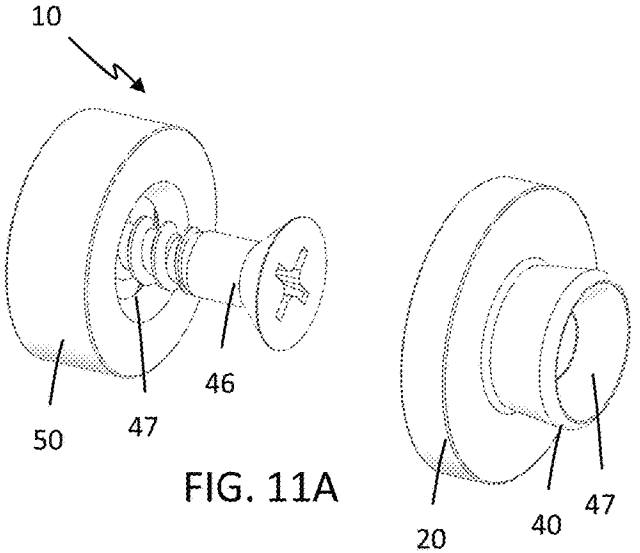
FIGS. 11A-11E are various illustrations of a magnetic fastening system, in accordance with exemplary embodiments of the present disclosure.
Figure 11B:
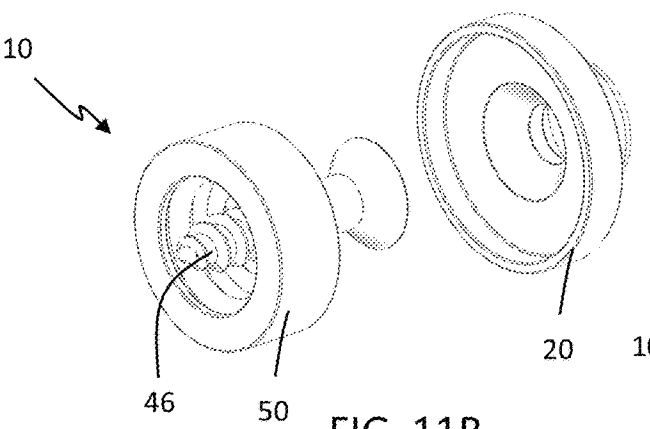
Figure 11C:
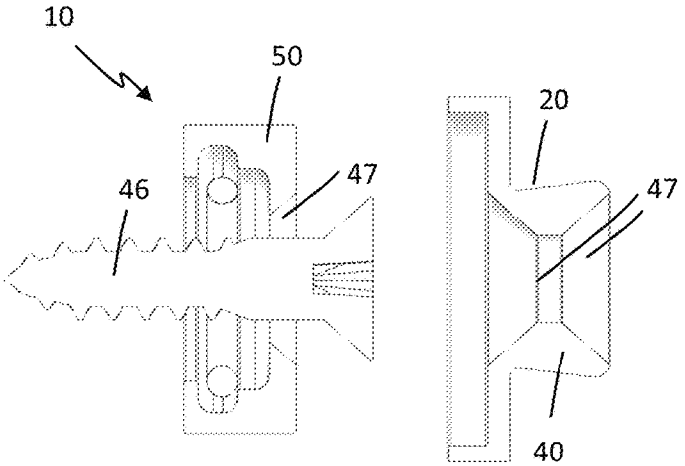
Figure 11D:
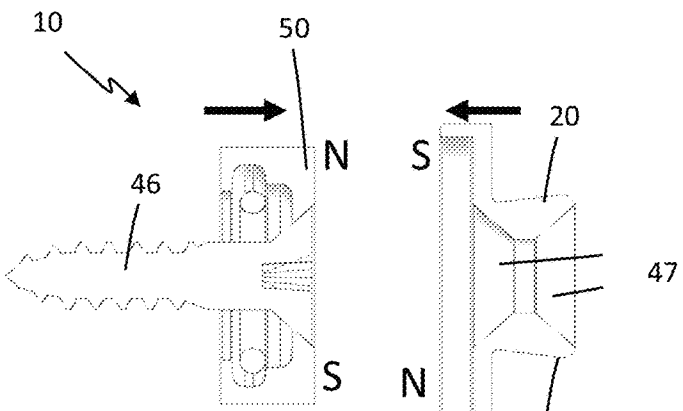
Figure 11E:
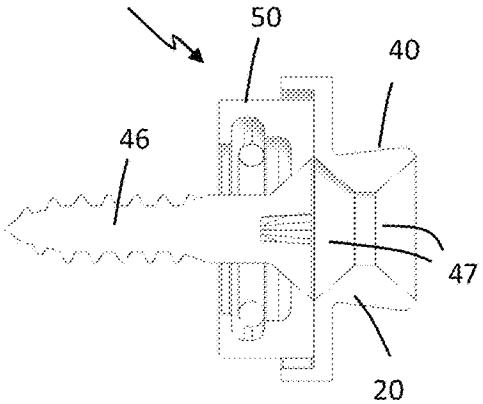

FIGS. 11A-11E are illustrations of a magnetic fastening system 10, in accordance with exemplary embodiments of the present disclosure. In particular, FIGS. 11B-11D illustrate the first and second fastener structure 20, 50 in exploded view but in alignment for connection, whereas FIG. 11E illustrates the first and second fastener structures 20, 50 in a non-exploded view. In this example, one or both of the first and second fastener structures 20, 50 have interior portion which is shaped to receive a threaded fastener 46, such as a #8 screw, where the tapered head of the screw 46 is capable of fitting within an interior recess 47 of the first and second fastener structures 20, 50. The screw 46 is used to fasten either or both of the first and second fastener structures 20, 50 to a substrate, such as a structure to which the system 10 connects. As shown in FIGS. 11A-11C, the screw 46 is positioned through an aperture in the second fastener structure 50, which may be formed from a solid magnetic material. The first fastener structure 20 may have a corresponding magnetic material positioned within the female pocket thereof, or it may be formed from a metal material which is attracted to the magnet of the second fastener structure 50.

In use, as shown in FIGS. 11D-11E, the screw 46 may be seated within the interior recess 47 of the second fastener structure 50, such that the head of the screw 46 is positioned flush or substantially flush with the terminating side of the second fastener structure 50. The magnetic material on the second fastener structure may be attracted to either the corresponding magnetic material on the first fastener structure, as depicted in FIG. 11D, or to a non-magnetic metal which is attracted to the magnetic field. The specific orientation of the magnetic field can be varied, as shown in FIG. 11D. The first fastener structure 20 is moved into the magnetic field of the magnetic material in the second fastener structure 50 until the terminating edge of the second fastener structure 50 is received within the pocket of the first magnetic structure, as depicted in FIG. 11E.

It is noted that either of the first and second fastener structures 20, 50 may have an interior recess 47 which receives the screw 46 in either direction. For instance, as shown in FIGS. 11C-11E, the interior recess 47 on the first fastener structure 20 is positioned in opposing directions, which allows the screw 46 to be inserted from either direction. This allows the fastener structure 20 to be mountable to the substrate in either direction, e.g., such that the female pocket side of the first fastener structure 20 faces outwards or so the friction-snap fastener 40 on the protruding male side of the first fastener structure 20 faces outwards. The second fastener structure 50 may have a similar construction of the interior recess 47 which is positioned in opposing directions. The flexibility of mounting the first and second fastener structures 20, 50 in either way gives the user flexibility to use the system 10 as needed for all situations.

FIGS. 12A-12F are illustrations of a magnetic fastening system 10, in accordance with exemplary embodiments of the present disclosure. In particular, FIGS. 12A-12F depict various orientations of the screw 46 relative to the first and second fastener structures 20, 50. In FIG. 12A-12C, the screws 46 are positioned in opposite directions in both of the first and second fastener structures 20, 50. When the screws 46 are fully received within the interior recesses 47 of the first and second fastener structures 20, 50, as shown in FIG. 12B, the magnetic force attracts the first and second fastener structures 20, 50 together such that they can achieve the position shown in FIG. 12C. Here, the second fastener structure 50 is positioned within the female pocket of the first fastener structure 20, and is magnetically engaged to the first fastener structure. With the screws 46 facing in opposite directions, the user has flexibility in attaching either the first and second fastener structures 20, 50 to any substrates. As an example, this design may be used when the existing buttons are deteriorated to the extent that they no longer function, such that the user can remove the existing buttons and attach the first and second fastener structures 20, 50 to the substrate.

FIGS. 12D-12E depict a similar design where one screw 46 is positioned through the first fastener structure 20 in a direction such that the head of the screw 46 is positioned proximate to the friction-snap fastener 40 on the male protrusion of the first fastener structure 20. Once in place, the second fastener structure 50 can be engaged with the friction-snap fastener 40 to secure the first and second fastener structures 20, 50 to one another mechanically, as shown in FIG. 12E. FIG. 12F illustrates the adjustable design of the first fastener structure 20 to allow the screw 46 to be received from either direction along the central axis of the first fastener structure 20.

Figure 13B:
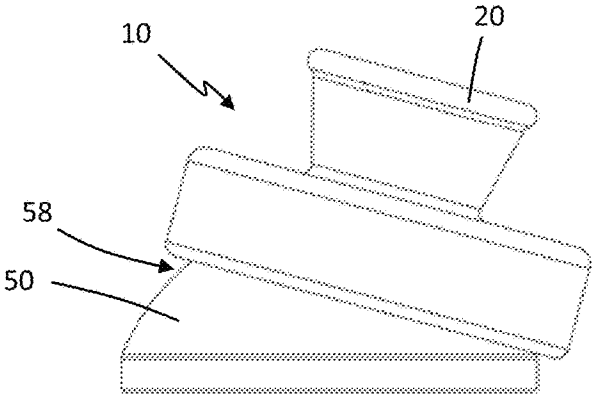
FIGS. 13A-13C are various illustrations of a magnetic fastening system, in accordance with exemplary embodiments of the present disclosure.
Figure 13A:
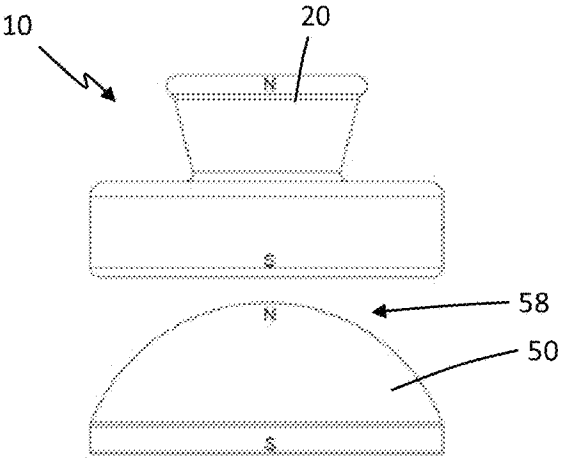
Figure 13C:
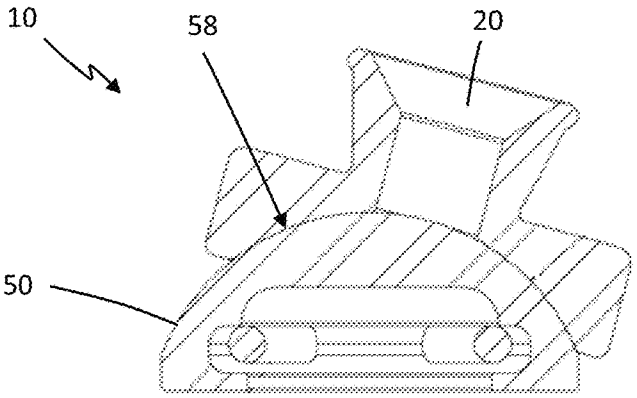

FIGS. 13A-13C are exploded-view illustrations of a magnetic fastening system 10, in accordance with exemplary embodiments of the present disclosure. In particular, FIGS. 13A-13C illustrate an example of the system 10 where the first fastener structure 20 and the second fastener structure 50 are mateable together with a curved engagement interface 58. The curved engagement interface 58 may be formed between a curved, convex shaped surface of the second fastener structure 50 and a corresponding curved, concave shaped surface within the receiving portion of the first fastener structure 20. One or both of the first and second fastener structures 20, 50 may be magnetic, such that the two structures are magnetically connectable together. It is noted that either of the first or second fastener structures 20, 50 may be manufactured from steel or a similar material, while the other is a ferromagnetic material, or both may be ferromagnetic materials with opposing magnetic fields, as identified in FIG. 13A. The curvature of the interface 58 may include various shapes, such as semi-hemispherical as shown in FIGS. 13A-13C, or other curved shapes. The curved engagement surface 58 allows for the first fastener structure 20 to move to a near infinite number of positions axially offset from the second fastener structure 50, thereby allowing the friction-snap fastener 40 on the first fastener structure 20 to be located in various axial or angular orientations. This adjustability of the first fastener structure 20 relative to the second fastener structure 50 can improve the usefulness of the system 10 by enabling connections with the system 10 are a wider degree of angles. It is noted that all other structures or features of the system 10 as depicted in FIGS. 13A-13C may be the same as described in the previous examples, and may include any of the same features, functionality, or aspects.

Figure 14A:
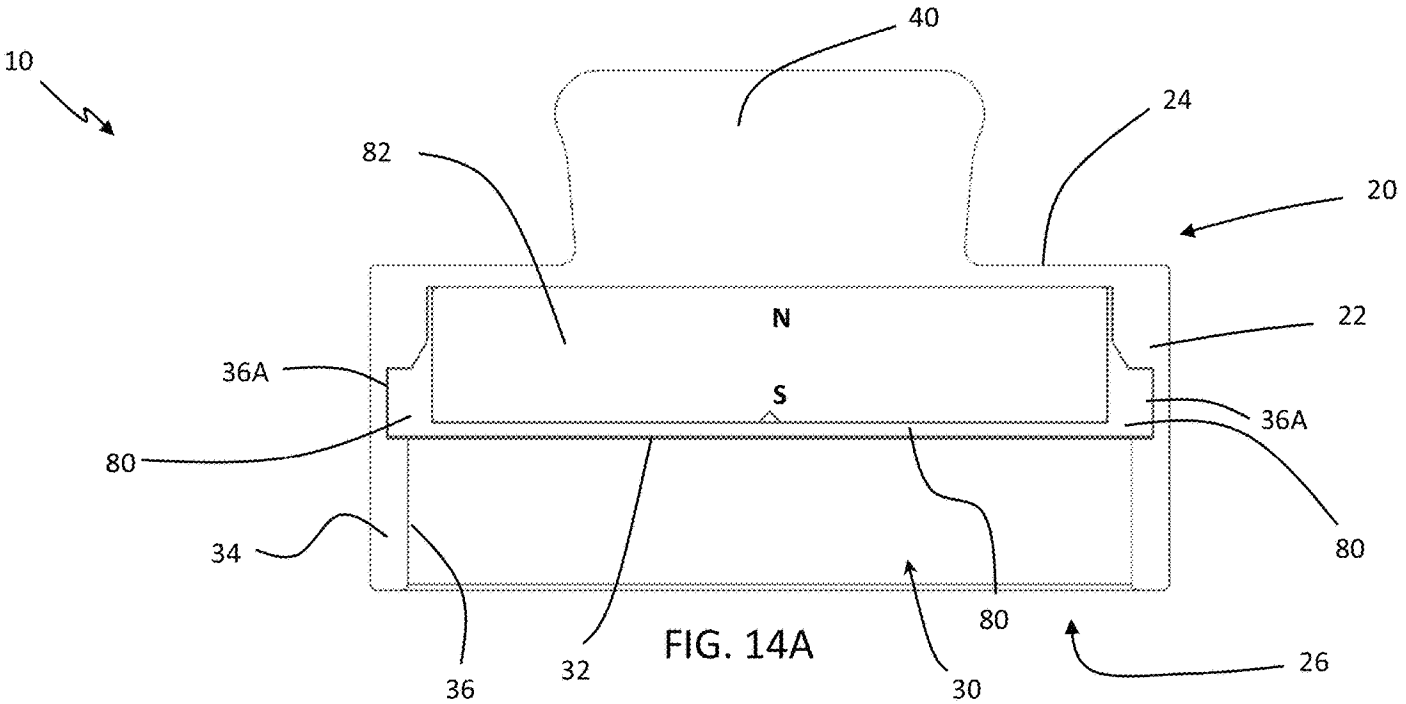
FIGS. 14A-14D are various illustrations of a magnetic fastening system, in accordance with exemplary embodiments of the present disclosure.
Figure 14B:
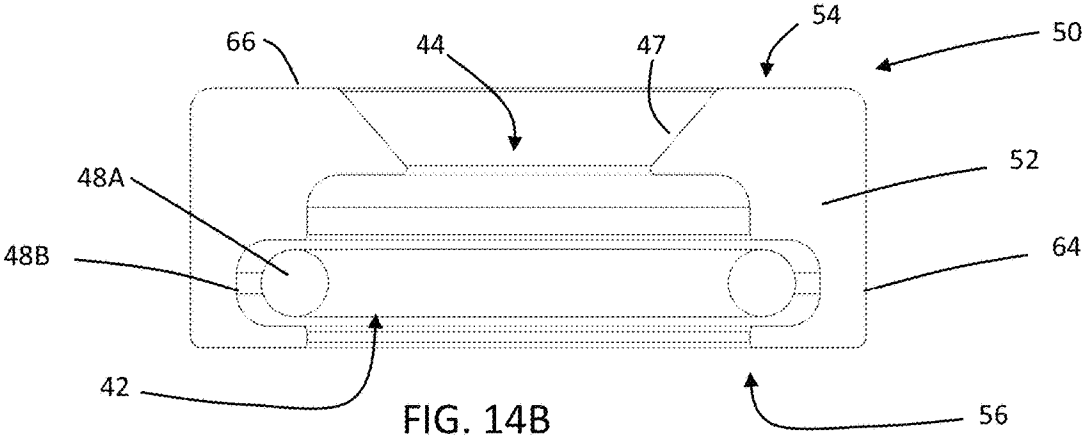

In another example, FIGS. 14A-14D are various illustrations of a magnetic fastening system 10, in accordance with exemplary embodiments of the present disclosure. With reference to FIGS. 14A-14B first, the magnetic fastening system 10 in this example, which may be referred to herein simply as 'system 10' includes a first fastener structure 20 and a second fastener structure 50 which are depicted in cross-sectional views. The first fastener structure 20 has a body 22 with a first side 24 and a second side 26. As shown in the figures, the body 22 may be formed with a disc shape or similar shape which is flattened, where the first side 24 is opposite the second side 26 on the body 22. As shown in FIG. 14A, at least one of a male friction-snap fastener 40 is positioned on the first side 24, such that the friction-snap fastener 40 extends from the first side 24. Alternatively, a female friction-snap fastener may be positioned on the first side 24, but this is not depicted in FIG. 14A. This friction-snap fastener 40 may be sized to be used with conventional metal friction-snap fasteners or push buttons, e.g., where the friction-snap fastener 40, when male, can be received within a female receptacle of a conventional friction-snap fastener and remain in place.

On the second side 26 of the body 22 is a pocket 30 which is formed as a counterbore within the body 22 which extends inward from a plane of a surface on the second side 26. As shown, the pocket has a recessed surface 32 or floor of the pocket 30 with a captive wall 34 formed around the recessed surface 32 such that all or a portion of the recessed surface 32 is circumferentially surrounded by the captive wall 34. The captive wall 34 may have an interior sidewall surface 36 which faces inwards towards a center point of the body 22, where the interior sidewall surface 36 may intersect at an annular corner junction with the recessed surface 32, in one example.

In another example, a wall cavity 36A may be formed in the sidewall surface 36 of the captive wall 34, e.g., on the interior surface of the captive wall 34, which may be used with a bonding structure 80 to retain a magnet 82 within the pocket 30 of the first fastener structure 20. For instance, as depicted in FIG. 14A, the pocket 30 of the first fastener structure 20 may be sufficiently dimensioned to allow a magnet 82 to be inserted therein, such that it is positioned at an innermost portion of the pocket 30, for instance, at a position where the magnet contacts the underside of the first side 24 of the first fastener structure 20. In this example, the magnet 82 may have a north pole (N) which faces the first side 24 and a south pole (S) which faces the second side 26 and the pocket 30. In one example, the magnet 82 may have ⅝ inch diameter and be approximately ⅛ inch thick, however, other dimensions are envisioned and the specific dimension of the magnet 82 used may depend on the size and shape of the first fastener structure 20. The magnet 82 in this position may cause the first fastener structure 20 to be magnetized, such that the magnetic forces provided by the magnet 82 are extended through all or part of the first fastener structure 20, whereby the first fastener structure 20 exhibits a magnetic force.

To retain the magnet 82 in this position, a bonding structure 80 may be used. The bonding structure 80 may include a bonding material, such as a bonding adhesive, epoxy, or similar material which can be inserted into the pocket 30 in a position abutting or substantially abutting the magnet 82. In one example, the bonding structure 80 may be inserted as a viscous material when the first fastener structure 20 is positioned upside-down on a level table, such that the viscous bonding material 80 flows on the exposed face of the magnet 82 and into the wall cavity 36A, where the bonding structure 80 may be cured or hardened to a solid state, the resulting material of which is waterproof or resistant to the ingestion of contaminants or unwanted substances. In this position, the bonding structure 80 may fully cover the exposed surface of the magnet 82, e.g., the surface which abuts the recessed surface 32, and be positioned at least partially in the wall cavity 36A, such that the bonding structure at least partially encapsulates the magnet 82. This encapsulation of the magnet 82 may substantially limit exposure of the magnet 82 to atmospheric conditions, such as salt in the air in costal settings, which can degrade the magnet 82 in short periods of time. The bonding material 80 may prevent contact between the magnet 82 and the air, as well as substances in the air such as salt, thereby significantly improving the longevity of the magnet's 82 operation and useful life.

In the example depicted in FIG. 14A, the bonding structure 80 may substantially cover at least one side of the magnet 82, such as where the bonding structure covers or overlaps all or nearly all of the underside of the magnet 82. In this example, the bonding structure 80 may form the recessed surface 32 of the pocket 30. In one of many alternatives, another material may be used overlapping the bonding structure 80 and act as the recessed surface 32, or in another example, the bonding structure 80 may cover only a portion of the magnet 82, such as just the radial edges thereof, and the surface of the magnet 82 may itself be the recessed surface 32.

Additionally, the bonding structure 80 may extend or be partially positioned within the wall cavity 36A all along the perimeter of the first fastener structure 20, such that the interface or connection between the bonding structure 80 and the wall cavity 36A prevents the bonding structure 80 from being dislodged in the pocket 30, e.g., where the wall cavity 36A can help ensure that the bonding structure 80 remains in place within the pocket 30, thereby holding the magnet 82 in place. The bonding structure 80 positioned in the wall cavity 36A provides for a mechanical retention of the magnet 82 within the first fastener structure 20 and it can provide an encapsulation of the magnet 82 to limit environmental degradation to the magnet 82.

For a bonding structure 80 which is applied in a viscous state, the bonding structure 80 may be cured with various catalysts such as UV light, time, heat, chemically, or otherwise. In one example, a UV bonding structure is utilized. The material of the bonding structure 80 which is positioned covering the face surface of the magnet 82 may be kept to a minimal thickness, such that the bonding structure 80 does not interfere with the magnetic force of the magnet 82. In another example depicted in FIG. 14D, the bonding structure 80 may be a non-viscous bonding device 84 which is biased into the pocket 30 to retain the magnet 82 in place. For instance, as shown, the non-viscous bonding device 84 in FIG. 14D may be disk, such as a sheet metal or stainless steel disk, a plastic disk, or a disk made from another material, preferably a material which does not corrode easily in the presence of salt, which can be pushed into the pocket 30 and slightly biased until it achieves a position within the wall cavity 36A around the entirety or a portion of the circumference of the first fastener structure 20. In this position, this push-type non-viscous bonding device 84 can mechanically hold the magnet 82 in place. A seal may be used around the edges of the non-viscous bonding device 84, e.g., along the terminating circular edge thereof, which prevents the infiltration of water or other materials. For instance, the viscous bonding structure 80 may be used in a limited quantity around the edges of the magnet 82 with the non-viscous bonding device 84 used over the face of the magnet 82, whereby the combination of the bonding structure 80 and the non-viscous bonding device 84 together hold the magnet 82 in place and prevent air, water, or other materials from accessing the magnet 82.

While the non-viscous bonding device 84 is described and depicted as a substantially rigid disk, it is noted that various other designs can be used, such as plastic retaining clips, rubber devices, or similar fasteners which are capable of holding the magnet 82 in place and/or preventing water or other substances from gaining access to the magnet 82, all of which are considered within the scope of the present disclosure.

The pocket 30 may have various sizes and other features. For example, the diameter of the pocket 30 may be sized to receive the second fastener structure 50, and thus be sized slightly larger than the diameter of the second fastener structure 50. Various tolerances can be used to ensure that there is adequate space to receive the second fastener structure 50 within the pocket 30, yet there is minimal or relatively minimal lateral or radial movement of the second fastener structure 50 within the pocket 30. The depth of the pocket 30, e.g., as measured from the terminating edge of the captive wall 34 to a plane of the recessed surface 32, may include various dimensions which may be dependent on one or more dimensions of the second fastener structure 50. For example, a depth of the pocket 30 may have a distance that is at least half of a height distance of the second fastener structure 50, e.g., as measured between the first side 54 and second side 56 of the second fastener structure 50. As such, when the second fastener structure 50 is inserted into the pocket 30, at least half of the height distance of the second fastener structure 50 is positioned within or received within the pocket 30. This may ensure that the second fastener structure 50 has a physical and magnet connection to the first fastener structure 20 via the pocket 30 which is sufficient to retain it in place and prevent inadvertent removal thereof. In other examples, the depth of the pocket 30 may be less than half of a height distance of the second fastener structure 50 or greater than half a height distance of the second fastener structure 50, or another dimension.

The first fastener structure 20, the pocket 30, and other components are described herein with various shapes, contours, features, and structures, and it is noted that various other shapes, contours, features, or structures may be included or omitted from the first fastener structure 20, the pocket 30, or other components, such as is shown in other figures of this disclosure, all of which are within the scope of the present disclosure.

FIG. 14B illustrates a second fastener structure 50 which magnetically mates with the first fastener structure 20. As shown, the second fastener structure 50 has a first side 54 and a second side 56 which are positioned substantially opposite one another on the body 52 of the second fastener structure 50. The second fastener structure 50 has a shape defined by an outer sidewall 64 thereof, e.g., where the shape of the outer sidewall 64 defines a general footprint of the second fastener structure 50, at least with regards to the part of the second fastener structure 50 which is inserted into the pocket 30. The shape of the outer sidewall 64 substantially matches a shape defined by the captive wall 34 of the pocket 30, such that the second fastener structure 50 is removably insertable into the pocket 30. In FIG. 14B, the outer sidewall 64 is illustrated as being circular, however other shapes may be used.

Figure 14C:
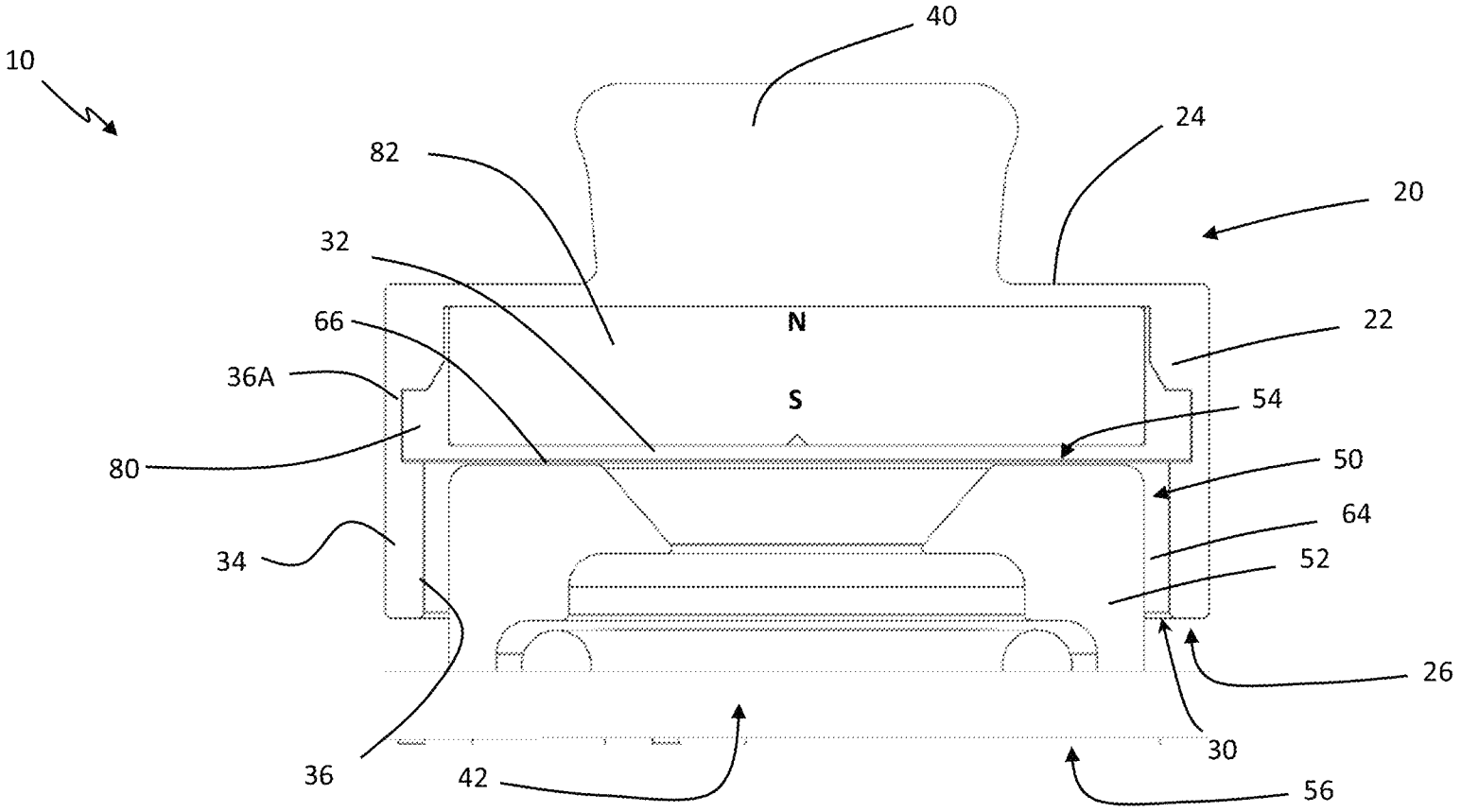
Figure 14D:
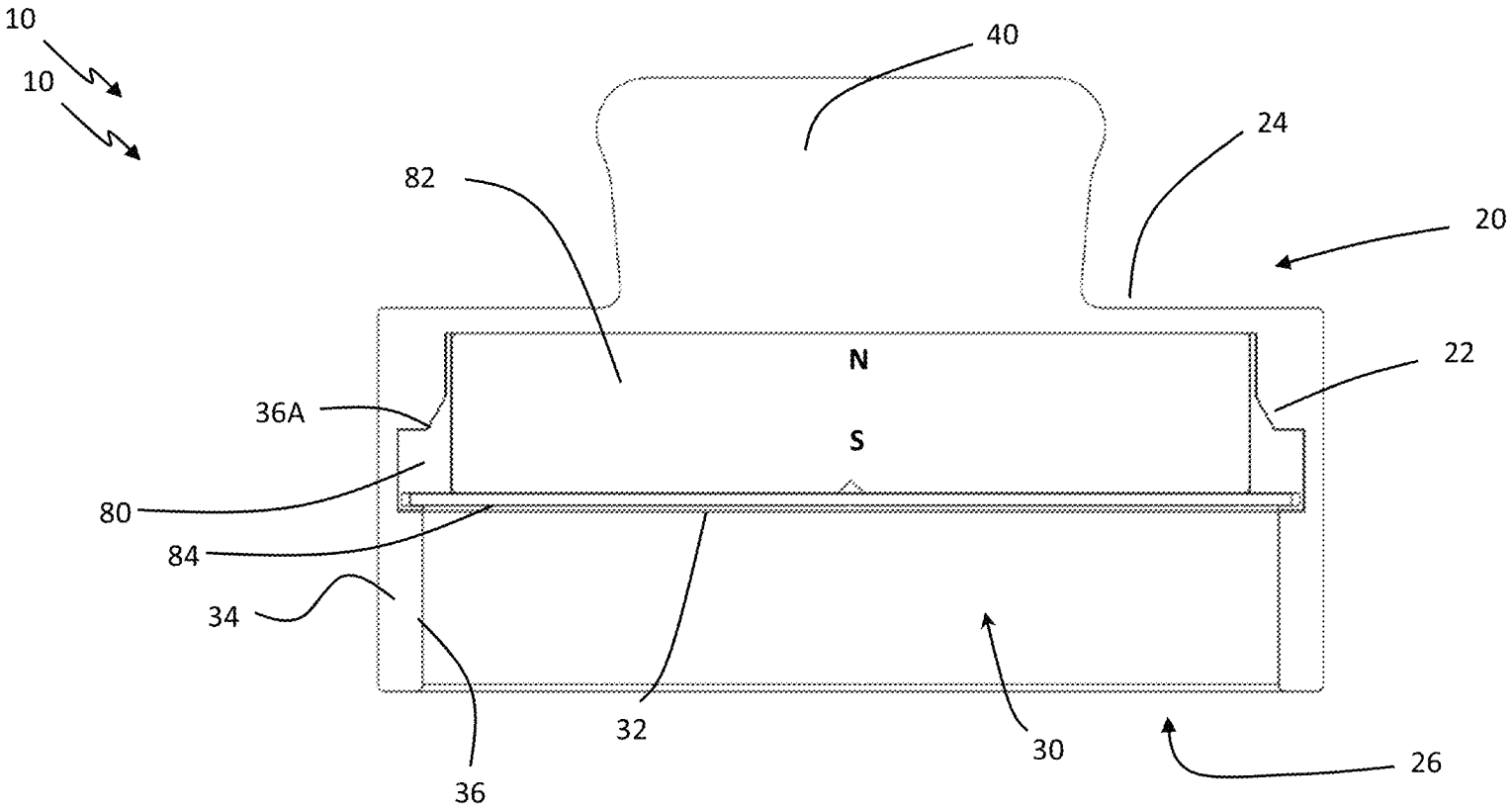

In use, the first and second fastener structures 20, 50 are mateable with the second fastener structure 50 being fully or partially insertable into the pocket 30 of the first fastener structure 20, which is best depicted in FIG. 14C. To ensure proper mating of these structures, the second fastener structure 50 may have a footprint or general shape which fully or substantially matches a shape defined by the captive wall 34 of the pocket 30 and have an outer diameter which is sized slightly smaller (toleranced) than the inner diameter of the pocket 30, such that the second fastener structure 50 fits within the pocket 30 easily, at least along diameters thereof. Preferably, the tolerance of the second fastener structure 50 to the pocket 30 allows for easy insertion and removal of the second fastener structure 50 but is sufficiently small enough to limit undesired radial movement of the second fastener structure 50 within the pocket 30, e.g., side wiggle.

One or both of the first and second fastener structures 20, 50 are magnetically energized, whereby one or both of these structures emits a magnetic field which attracts or repels a ferromagnetic material. In FIGS. 14A-14D, the first fastener structure 20 includes the magnet 82 which acts to magnetize the magnetizable portions of the first fastener structure 20. As shown, the south pole (S) of the magnet 82 may attract the second fastener structure 50, which may have an opposite polarity such that the two structures are magnetically attracted to one another. Both the first and/or the second fastener structures 20, 50 may be formed from ferritic material, such as being formed from marine grade 2205 stainless steel, where the ferritic nature of the components allows a magnet 82 to magnetically connect but also allows the components to be rust resistant. In the example shown in FIG. 14C, the second fastener structure 50 is formed from a ferromagnetic material such that it is capable of magnetically attracting to the magnet 82 within the first fastener structure 20. In other examples, there may be the use of two magnetically energized fasteners versus only one magnetically energized fastener, which may allow for stronger and weaker magnetic attraction forces, respectively, between the first and second fastener structures 20, 50.

The magnetic force between the first and second fastener structures 20, 50 may be selected based on the intended use of the magnetic fastener system 10. For instance, magnetic force may be sufficient to prevent inadvertent separation between the first and second fastener structures 20, 50, but it may be limited enough to ensure that a user can separate the two structures when desired. While the specific magnetic force may vary, in one example the first and second fastener structures 20, 50 may have a magnetic force which is substantially 1 lb., 2 lbs., 3 lbs., 5 lbs., 10 lbs., or more, or any other increment therebetween. More specifically, when the system 10 is intended to be used in harsh environments such as on a boat in the ocean where the system 10 will be subjected to G-forces from fast boat operating, wind, and other direct forces, it may be desirable to have a magnetic attraction force which is high. In contrast, if the system 10 is used in stable, calm environments, small magnetic attraction forces can be used.

In use, as the second fastener structure 50 is moved towards the pocket 30 of the first fastener structure 20, the magnetic force between the structures biases the two structures together. The upper end of the second fastener structure 50 passes by the exterior of the captive wall 34 and moves along the sidewall 36 of the captive wall 34 until the top, exterior planar surface 66 of the second fastener structure 50 contacts the recessed floor 32 of the pocket 30. As previously mentioned, preferably, the pocket 30 depth is selected to match the desired insertion distance of the second fastener structure 50 into the pocket 30. The captive wall 34 not only ensures that the second fastener structure 50 can be positioned properly to magnetically mate with the recessed floor 32, but importantly, the captive wall 34 prevents the second fastener structure 50 from moving or sliding in a lateral or radial direction away from magnetic force of the recessed floor 32. Without the captive wall 34, the magnetic connection between the second fastener structure 50 and the recessed floor 32 may be substantially weakened if the two structures move lateral to one another such that the magnetic field there between is weakened and can no longer hold the two structures together.

While the first fastener structure 20 includes the friction-snap fastener 40 on its first side 24, the system 10 may also include an additional friction-snap fastener 42 located on the second side 56 of the second fastener structure 50. As shown in FIGS. 14A-14B, this additional friction-snap fastener 42 may be a female version, such that it can receive the male end of a third fastener structure, such as a conventional metal friction-snap fastener, which is removably connectable to the at least one of the male friction-snap fastener 40 or the female friction-snap fastener 42. The female friction-snap fastener 42 may operate with a biased ring 48A which is positioned within an annular groove 48B within a cavity of the female friction-snap fastener 42, whereby when the male friction-snap fastener is pushed into the cavity, it slightly biases the ring 48A outwards until the ring 48A moves beyond a lip of the male friction-snap fastener 40, at which point the ring 48A moves inward and holds the male friction-snap fastener 40 within the cavity (the final position of which is depicted, for instance, in FIG. 16C, as an example). The friction-snap fasteners 40, 42 may be used to connect with other fastener structures, such as those shown in FIGS. 16A-16C, or other fastener structures, such as existing metal friction-snap fasteners on various articles, items, or structures.

Figure 15A:
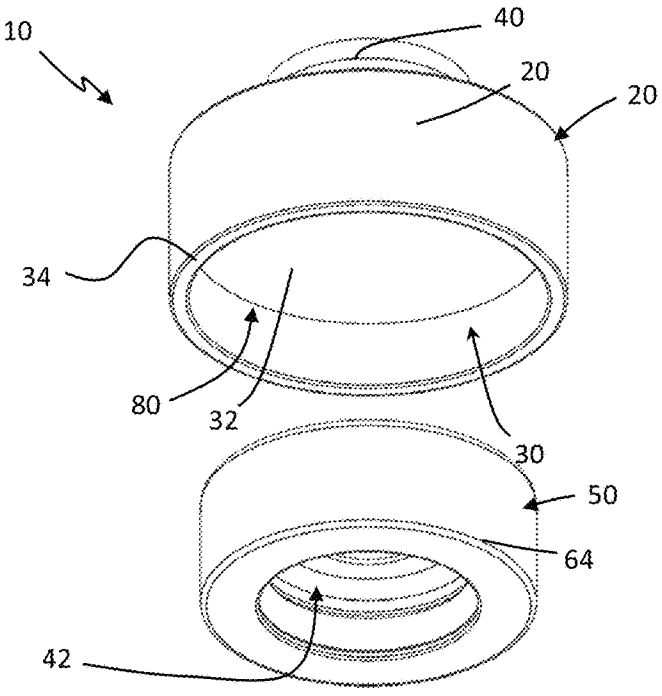
FIGS. 15A-15E are various illustrations of a magnetic fastening system, in accordance with exemplary embodiments of the present disclosure.
Figure 15B:
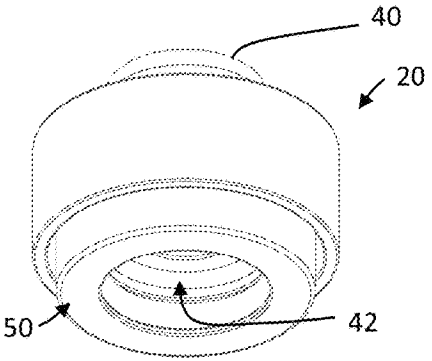
Figure 15C:
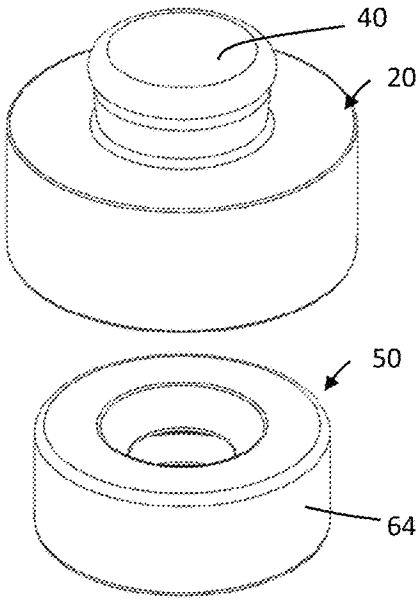
Figure 15D:
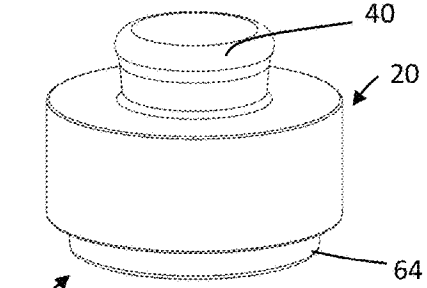
Figure 15E:
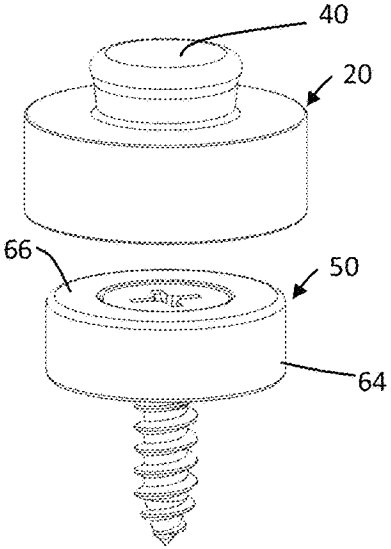

As further shown in FIG. 14B-14C, the second fastener structure 50 may also include a central aperture 44 which extends through the second fastener structure 50 and allows for a threaded fastener (not shown) to be used to secure the second fastener structure 50 to another article. For instance, the central aperture 44 may include an interior recess 47 with angled sidewalls which receive the head of a threaded fastener, such as a screw, while the body of the screw is positioned through the second fastener structure 50, such that it can be threadedly engaged with another article (not shown). This concept is illustrated in FIG. 15E, and is also discussed in detail relative to FIGS. 8A-12F, the teachings of which are all considered within the scope of the example of the system 10 depicted and described relative to FIGS. 14A-14D.

In furtherance of the system 10 described relative to FIGS. 14A-14D, FIGS. 15A-15E are various illustrations of the magnetic fastening system 10 and the components thereof, in accordance with exemplary embodiments of the present disclosure. These additional illustrations of the system 10 and the components of the system 10 are provided for additional visual clarity in the features and structures of the system 10 and the components thereof, the descriptions of which is included in the description of the system 10 corresponding to FIGS. 14A-14D and not repeated herein again for efficiency of disclosure.

While the system 10 may have uses in many industries and with many products, it may be particularly beneficial within the boating industry. As discussed in the Background, boats typically have seats formed from fiberglass, wood, plastics, or metal, which have cushions that removably attach to those seats. The attachment between the cushions and the seats with the conventional metal friction-snap fasteners is prone to having problems as the metal fasteners rust, corrode, or degrade, which is very common in saltwater environments, and the result is often a user trying to remove a cushion with such force that the cushion fabric rips. Replacing fasteners on the boats and cushions or replacing the cushions themselves is expensive. The system 10 may provide a solution to the user, where the fastener structures 20, 50 of the system 10 can be attached to the existing metal friction-snap fasteners on the boat and cushion, or on any other securable articles, and the magnetic attraction between the first and second fastener structures 20, 50 holds the cushion to the seats. When the user wishes to remove the cushions, he or she can simply pull on the cushion enough until he or she overcomes the magnetic force between the first and second fastener structures 20, 50, thereby releasing the cushion from the seat. The first and second fastener structures 20, 50 can remain attached to the boat and cushion, respectively, via the friction-snap fasteners 40, 42, such that the rusted, corroded, or otherwise damaged buttons on the boat or cushion are no longer an impediment to removing the cushions.

While the system 10 is described within the boating field, this same principle of use can be used between any two securable articles, such as any two items or structures which are capable of being secured together with the system 10, such as, for instance, awnings, fabric coverings, automotive coverings, or any other articles.

Figure 16A:
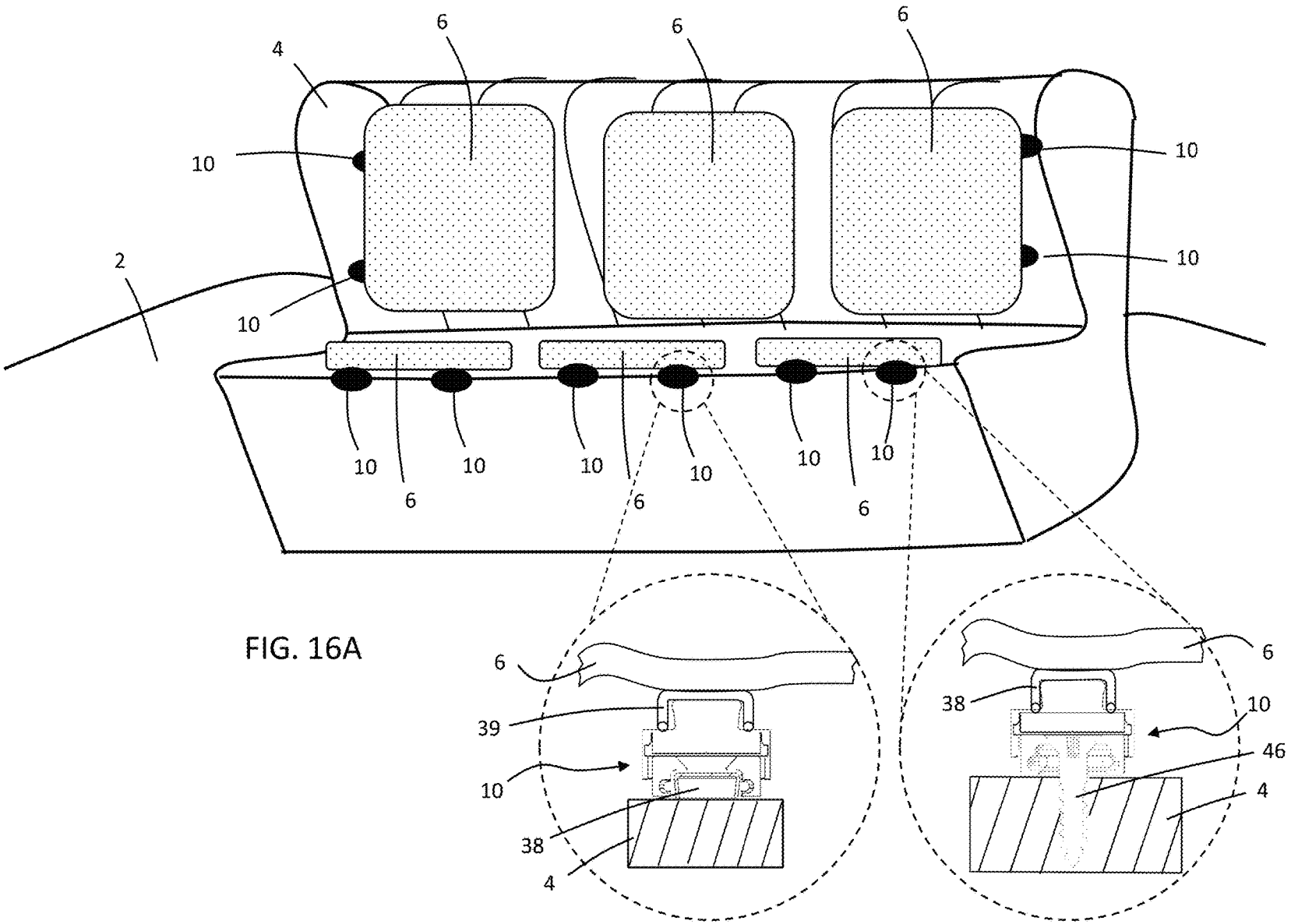
FIG. 16A is an illustration of a magnetic fastening system in use with a securable article, in accordance with exemplary embodiments of the present disclosure.

To connect various articles together, the system 10 may utilize a third fastener structure, which may include a fastener structure positioned on a seating article, such as, for instance, a seating article that comprises at least one of: a seat, a bench, a seat on a boat, a seat cushion, or a seat fabric. To this end, FIG. 16A is an illustration of a magnetic fastening system 10 in use with a securable article, in accordance with exemplary embodiments of the present disclosure. In particular, FIG. 16A illustrates the system 10 in use with a boat 2, where the system 10 is used to secure a first securable article 6, such as a seat cushion, to a second securable article, such as a seat 4 on the boat 2. In the manner previously described the system 10 may magnetically connect the seat cushions 6 to the seat 4, thereby holding them in place for intended use but preventing inadvertent disconnection of the articles. FIG. 16A also illustrates two enlarged sections showing the use of the system 10 in detail, where in the lefthand detail bubble, the system 10 is in use with a third fastener 38 connected to the seat 4 and an additional fastener 39 connected to the first securable article 6. In the righthand bubble, the system 10 is connected with the third fastener 38 to the first securable article 6 and the other side of the system 10 is connected with threaded fastener 46 to the seat 4. In these situations, the third fastener 38 may be an existing, factory-installed snap button fastener. In other, similar examples, the third fastener 38 may be the enlarged-diameter fastener 90, either male or female, which are depicted and described relative to FIGS. 16B-16C, such as where an existing, factory-installed snap button has been removed or degraded to the point where it cannot be connected to the system 10.

Figure 16B:
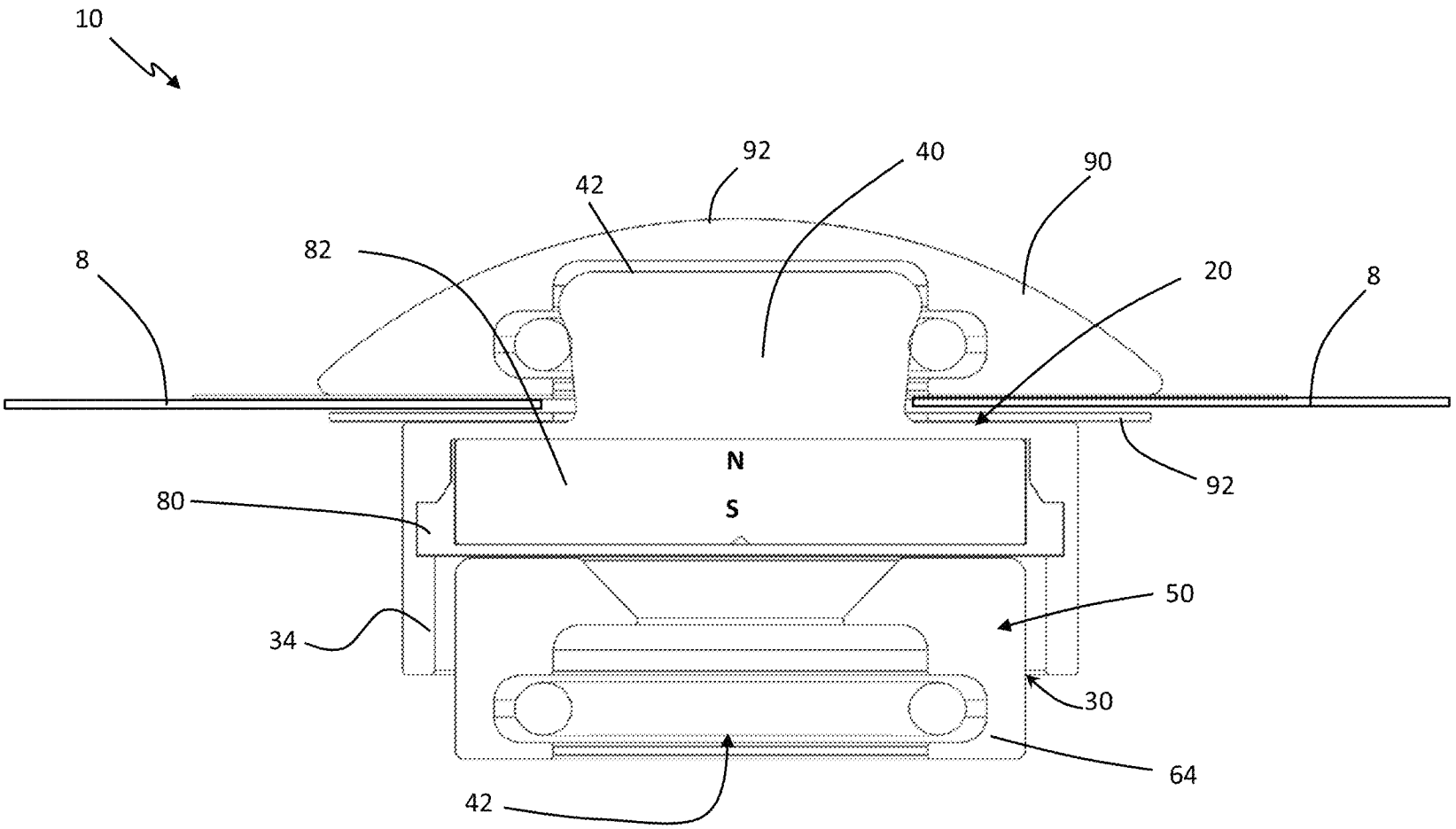
FIGS. 16B-16C are various illustrations of a magnetic fastening system with an enlarged-diameter fastener structure, in accordance with exemplary embodiments of the present disclosure.
Figure 16C:
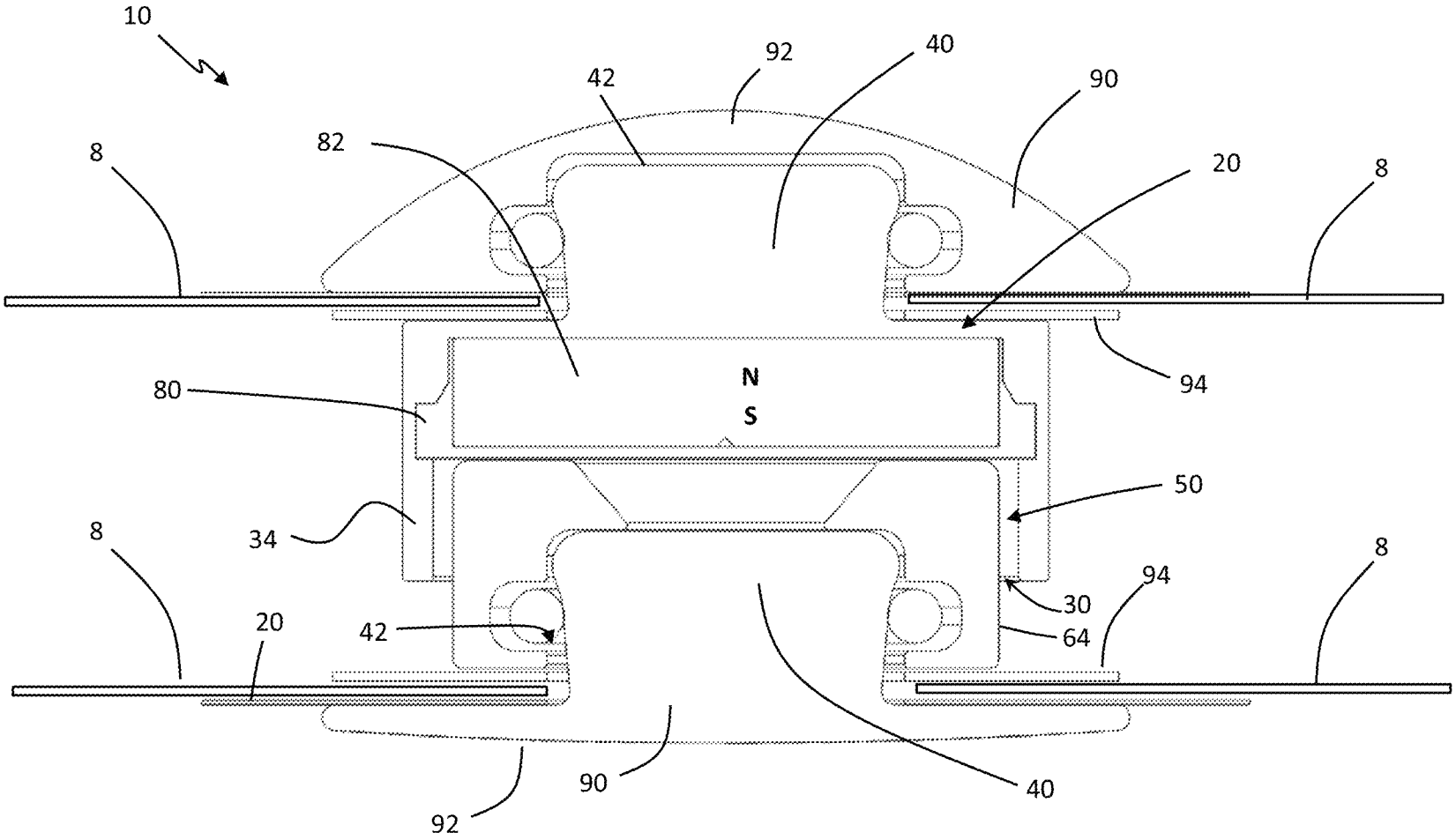

In a similar example, FIGS. 16B-16C illustrate the system 10 in use with an article that is a fabric or similar textile material, and where an existing button may have gone missing or has been removed, for instance, such as where a button has been lost from a textile cover, fabric awning, or similar structure. FIGS. 16B-16C are various illustrations of a magnetic fastening system 10 with an enlarged-diameter fastener structure 90, in accordance with exemplary embodiments of the present disclosure. As shown in FIG. 16B, the system 10 may be used to connect to a fabric material 8 using a third fastener structure, such as an enlarged-diameter fastener structure 90 which connects to the male friction-snap fastener 40 of the first fastener structure 20. The enlarged-diameter fastener structure 90 may be a structure with a first side and a second side, the first side opposite the second side, where a female friction-snap fastener 42, e.g., a receiving portion, is formed therein extending from one side, such that it can connect to a male friction-snap fastener 40 with the fabric material 8 positioned therebetween, whereby the enlarged-diameter fastener structure 90 and the first fastener structure 20 effectively secure the fabric material 8 therebetween.

In FIG. 16C, a similar design is shown to that in FIG. 16B, but the additional use of a second enlarged-diameter fastener structure 90 is provided which is connected to the second fastener structure 50 using a male friction-snap fastener 40 positioned on the enlarged-diameter fastener structure 90 and engaging with the female friction-snap fastener 42 of the second fastener structure 50, and where a fabric material is also positioned between these two structures.

In either or both of the examples of FIGS. 16B-16C, the enlarged-diameter fastener structure 90 may be used to provide additional surface area for contacting the fabric material 8. For example, the diameter of the enlarged-diameter fastener structure 90 may be substantially larger at a largest point thereof than that of the first or second fastener structures 20, 50, such that the overall diameter of the enlarged-diameter fastener structure 90 greatly exceeds the diameter of the first fastener structure 20 and the second fastener structure 50. For example, in one situation, the diameter of the enlarged-diameter fastener structure 90 may be 2 or more times larger than the diameter of the first fastener structure 20 and the second fastener structure 50. In other examples, the diameter of the enlarged-diameter fastener structure 90 may be 3, 4, 5 or 10 times larger than the diameter of the first fastener structure 20 and the second fastener structure 50.

While the enlarged-diameter fastener structure 90 contacts the fabric material 8 on one of the sides thereof, e.g., either the first side or second side, directly or indirectly, the opposite side which faces outwards from the fabric material 8 may have a smoothed surface 92, such as gently arced surface, as shown. The smoothed surface 92 may be intended to not interfere or 'catch' any other objects, such that if an object contacts the smoothed surface 92, it simply moves over it with minimal resistance.

Figure 17B:
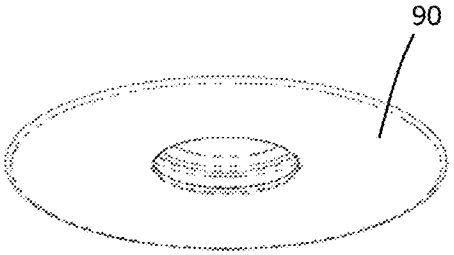
FIGS. 17A-17G are various illustrations of the enlarged-diameter fastener structure and associated components, used with magnetic fastening system, in accordance with exemplary embodiments of the present disclosure.
Figure 17C:
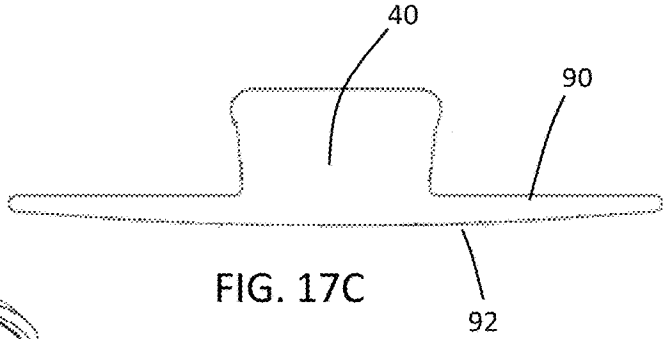
Figure 17D:
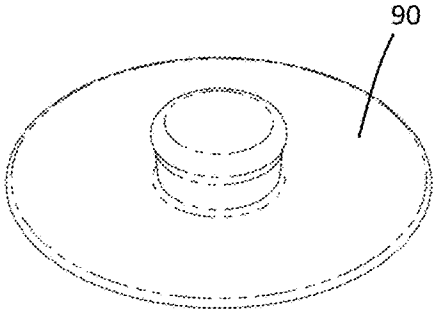
Figure 17A:
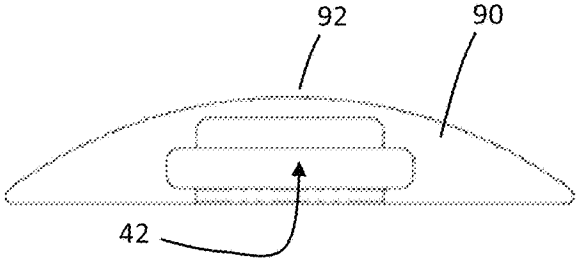
Figure 17F:
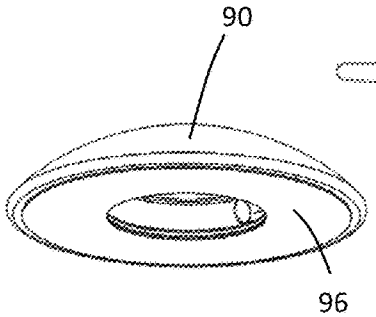
Figure 17E:
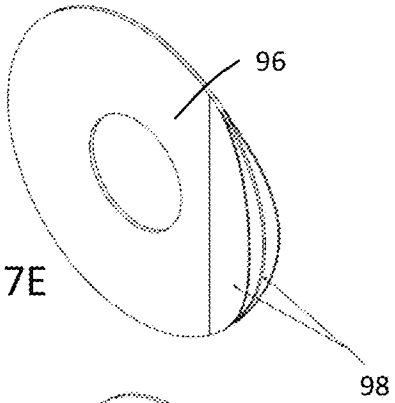
Figure 17G:
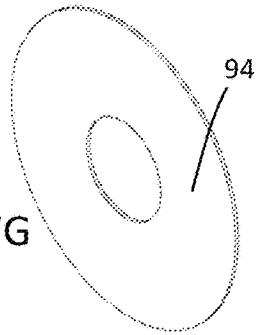

Additionally, it is noted that a cushion disk 94 may be used to help make a strong and high-friction contact with the fabric material 8. For instance, as shown, the cushion disk 94 may be a substantially cylindrical disk with an aperture, where one broad face of the cylindrical disk contacts the fabric material 8 and at least a portion of the opposing broad face of the cylindrical disk contacts the first or second fastener structure 20, 50, depending on orientation during use. The cushion disk 94 may have a diameter which substantially matches the diameter of the enlarged-diameter fastener structure 90. The cushion disk 94 may allow for a larger surface area of contact with the fabric material 8 in a position opposing the enlarged-diameter fastener structure 90, which may increase friction and the holding force the system 10 has to the fabric material 8. An adhesive material, such as an adhesive tape 96 (FIG. 17E-17F) with a removable release film 98 (FIG. 17E-17F) may be used within this interface in a positioned abutting the enlarged-diameter fastener structure 90 (FIGS. 17E-17F) to further increase the friction of the connection with the fabric material 8.

As can be seen, in FIG. 16B, the system 10 may be used with one enlarged-diameter fastener structure 90 which is used to secure the system 10 to one fabric material 8, whereas in FIG. 16C, the system 10 may be used with two enlarged-diameter fastener structures 90 which are used to each secure the system 10 to one fabric material 8, e.g. on either side, such that the two fabric materials 8 collectively can be magnetically connected together with the system 10. In this manner, it is possible to use the system 10 to connect together two fabric materials 8 but still allow for separation of these materials when desired by the user by breaking the magnetic connection between the first and second fastener structures 20, 50. While this system 10 may have numerous uses and benefits, the particular use of the enlarged-diameter fastener structure 90 as described relative to FIGS. 16B-16C may be highly beneficial for use with fabric materials where previous buttons have been damaged and removed, or with fabric materials 8 that didn't have buttons but a user still desires to connect them to an article or together.

In furtherance of the system 10 described relative to FIGS. 16B-16C, FIGS. 17A-17G are various illustrations of the enlarged-diameter fastener structure and associated components, used with magnetic fastening system, in accordance with exemplary embodiments of the present disclosure. These additional illustrations of the system 10 and the components of the system 10, including the enlarged-diameter fastener structure 90, are provided for additional visual clarity in the features and structures of the system 10 and the components thereof, the descriptions of which is included in the description of the system 10 corresponding to FIGS. 16B-16C and not repeated herein again for efficiency of disclosure.

Figure 18B:
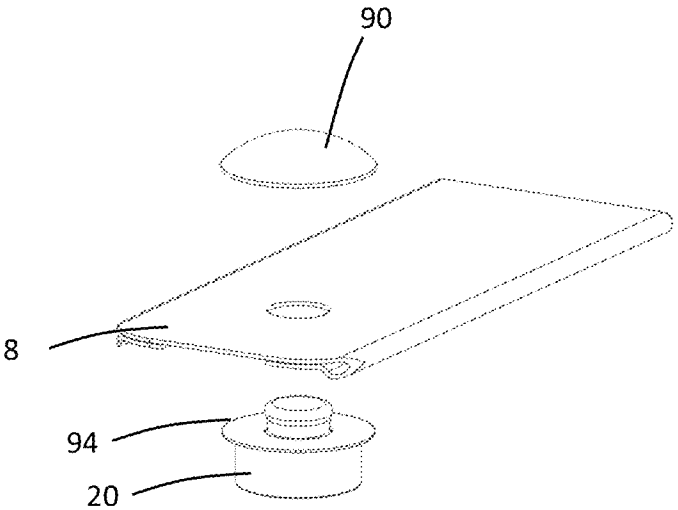
FIGS. 18A-18D are various illustrations depicting steps in an article repair process using the magnetic fastening system, in accordance with exemplary embodiments of the present disclosure.
Figure 18D:
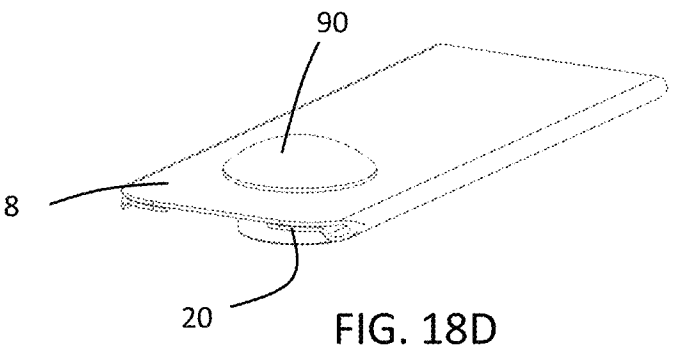
Figure 18A:
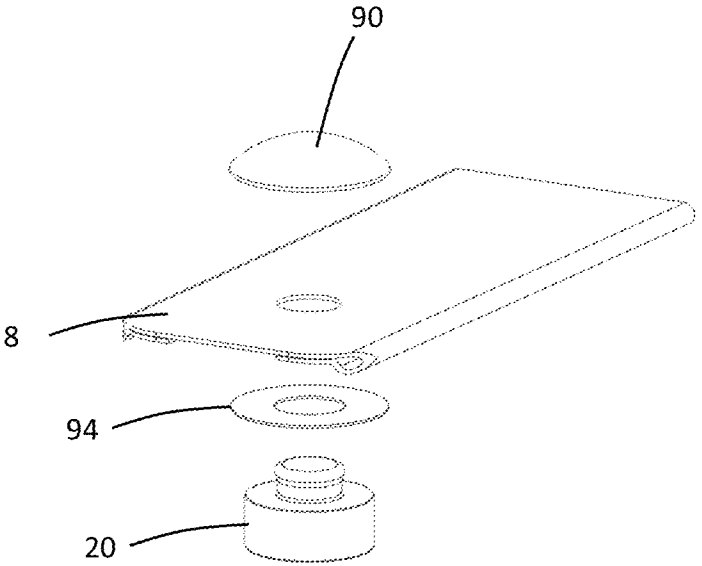
Figure 18C:
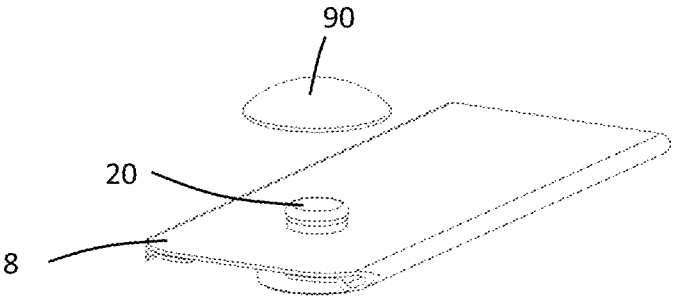

FIGS. 18A-18D are various illustrations depicting steps in an article repair process using the magnetic fastening system 10 described relative to FIGS. 16B-16C with an enlarged-diameter fastener structure 90, in accordance with exemplary embodiments of the present disclosure. As shown in FIG. 18A, the components are provided, including the first fastener structure 20, the cushion disk 94, and the enlarged-diameter fastener structure 90. In FIG. 18B, the cushion disk 94 is positioned over the male friction-snap fastener of the first fastener structure 20, and then the male friction-snap fastener is inserted through a hole in the fabric material 8, as shown in FIG. 18C. The enlarged-diameter fastener structure 90 is then connected to the male friction-snap fastener in FIG. 18D, thereby securing the fabric material 8 therebetween.

Figure 19C:
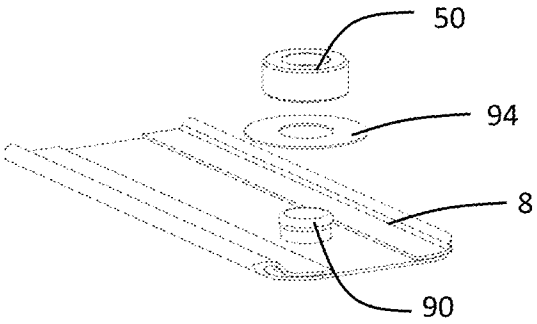
FIGS. 19A-19E are various illustrations depicting steps in an article repair process using the magnetic fastening system, in accordance with exemplary embodiments of the present disclosure.
Figure 19B:
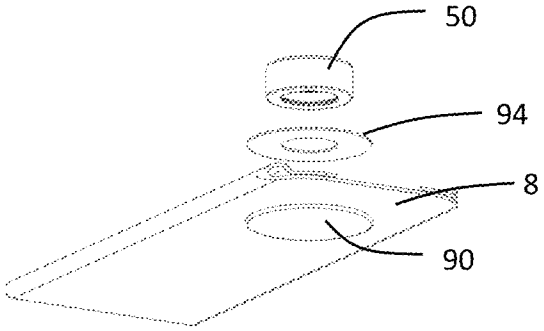
Figure 19A:
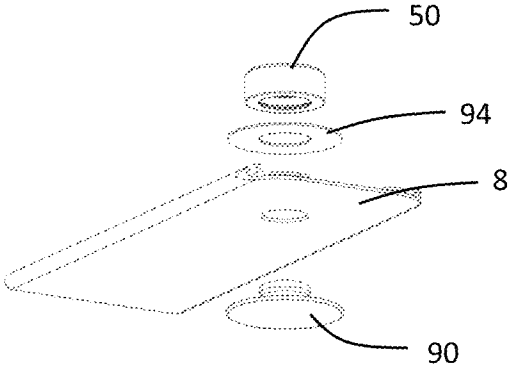
Figure 19E:
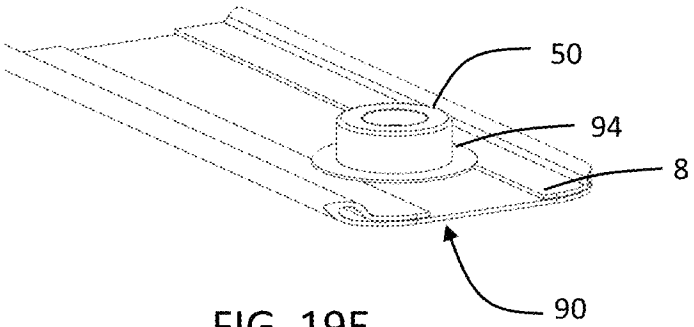
Figure 19D:
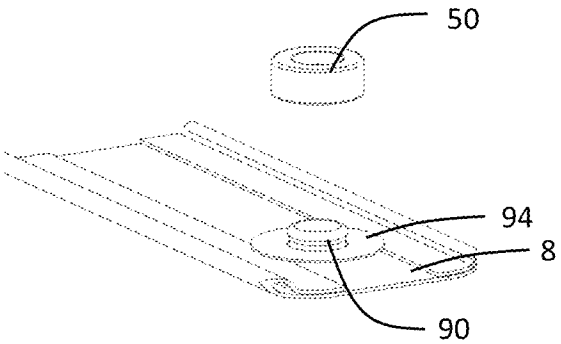

In a similar manner, FIGS. 19A-19E are various illustrations depicting steps in an article repair process using the magnetic fastening system 10 described relative to FIGS. 16B-16C with an enlarged-diameter fastener structure 90, in accordance with exemplary embodiments of the present disclosure. As shown in FIG. 19A, the components are provided, including the second fastener structure 50, the cushion disk 94, and the enlarged-diameter fastener structure 90. In FIG. 19B, the enlarged-diameter fastener structure 90 has a male friction-snap fastener which is positioned through a hole in the fabric material, as also depicted in FIG. 19C. The cushion disk 94 is positioned over the male friction-snap fastener of the enlarged-diameter fastener structure 90 (FIG. 19D), and then the second fastener structure 50 is connected to the male friction-snap fastener of the enlarged-diameter fastener structure 90, e.g., by connecting the female friction-snap fastener of the second fastener structure 50. The fabric material 8 is secured therebetween. With both FIGS. 18A-18D and 19A-19E, the fabric materials 8 secured therein can then be connected together with a magnetic connection using the system 10 by connecting the first and second fastener structures together.

It is noted that while the disclosure herein uses various examples, such as holding cushions to boat seats, the system 10 may offer benefits in a wide range of settings and environments where conventional snap buttons are used. For instance, the system may provide benefits with any outdoor fabric based structure, such as tents, gazeboes, ramadas, awnings, or umbrellas. The system 10 may also offer benefits in many indoor settings, where deterioration of a conventional snap button is not an issue, but that the use of the system may simply provide a more efficient means of connecting and disconnecting two articles together. Additionally, it is noted that the system 10 may be used both to retrofit or improve existing conventional snap buttons, and as a component with articles of new manufacture. All variations in design of the system 10 and its components, and all such options for use are considered within the scope of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A magnetic fastener system comprising:

a first fastener structure having;

a body with a first side and a second side, wherein the first side is opposite the second side;

at least one of a male friction-snap fastener or female friction-snap fastener positioned on the first side;

a pocket formed within the second side of the body;

a magnet positioned within the pocket;

a recessed surface formed in an interior of the pocket and enclosing the magnet in the pocket, wherein a captive wall is formed around the recessed surface, wherein at least a portion of the recessed surface is positioned substantially perpendicular to the captive wall, and wherein the magnet is positioned above the portion of the recessed surface and at least partially between the recessed surface and the male friction-snap fastener or female friction-snap faster on the first side; and a second fastener structure having a shape defined by an outer sidewall, wherein the shape of the outer sidewall substantially matches a shape defined by the captive wall, wherein second fastener structure is removably insertable into the pocket, and wherein the first and second fastener structures are magnetically connectable, and the magnet is positioned above a footprint of the second fastener structure with the recessed surface interfacing between the second fastener and the magnet when the second fastener is in a connected position with the first fastener structure, wherein at least a third fastener structure is removably connectable to the at least one of the male friction-snap fastener or the female friction-snap fastener positioned on the first side of the first fastener structure.

2. The magnetic fastener system of claim 1, further comprising a bonding structure positioned within the pocket and substantially covering at least one side of the magnet, wherein the bonding structure retains the magnet within the pocket.

3. The magnetic fastener system of claim 2, wherein the bonding structure further comprises a substantially planar disk formed from metal or plastic, wherein the recessed surface is formed on one side of the substantially planar disk.

4. The magnetic fastener system of claim 3, further comprising a wall cavity formed in an interior sidewall surface of the captive wall, wherein the substantially planar disk is positioned at least partially within the wall cavity, wherein a terminating circular edge of the substantially planar disk is positioned interior of the interior sidewall surface of the captive wall.

5. The magnetic fastener system of claim 1, wherein, with the magnet positioned within the pocket, the first fastener structure is magnetized.

6. The magnetic fastener system of claim 1, wherein at least one of the first fastener structure and the second fastener structure are formed from a ferritic material.

7. The magnetic fastener system of claim 1, wherein the captive wall formed around the recessed surface extends a distance, wherein the distance is at least half of a height distance of the second fastener structure, whereby when the second fastener structure is inserted into the pocket, at least half of the height distance of the second fastener structure is positioned within the pocket.

8. The magnetic fastener system of claim 1, wherein the third fastener structure further comprises a fastener structure positioned on a seating article, wherein the seating article comprises at least one of: a seat, a bench, a seat on a boat, a seat cushion, or a seat fabric.

9. The magnetic fastener system of claim 1, wherein the third fastener structure further comprises an enlarged-diameter fastener structure, wherein a diameter of the enlarged-diameter fastener structure at a largest point thereof, is greater than a diameter of the first fastener structure and the second fastener structure.

10. The magnetic fastener system of claim 9, wherein the enlarged-diameter fastener structure has a first side and a second side, wherein the first side is opposite the second side, wherein at least one of a male friction-snap fastener or female friction-snap fastener positioned on the first side and is engageable with the first fastener structure or the second fastener structure, wherein the second side of the enlarged-diameter fastener structure has a smoothed surface.

11. The magnetic fastener system of claim 10, further comprising a cushion disk positioned between the first side of the enlarged-diameter fastener structure and the first fastener structure or the second fastener structure fastener structure.

12. The magnetic fastener system of claim 11, wherein the cushion disk has a diameter which substantially matches the diameter of the enlarged-diameter fastener structure.

13. A magnetic fastener system comprising:

a first fastener structure having;

a body with a first side and a second side, wherein the first side is opposite the second side;

at least one of a male friction-snap fastener or female friction-snap fastener positioned on the first side;

pocket formed within the second side of the body;

a magnet positioned within the pocket;

a recessed surface formed in an interior of the pocket and enclosing the magnet in the pocket, wherein a captive wall is formed around the recessed surface, wherein at least a portion of the recessed surface is positioned substantially perpendicular to the captive wall, and wherein the magnet is positioned above portion of the recessed surface and at least partially between the recessed surface and the male friction-snap fastener or female friction-snap fastener on the first side; and a second fastener structure having a shape defined by an outer sidewall, wherein the shape of the outer sidewall substantially matches a shape defined by the captive wall, wherein second fastener structure is removably insertable into the pocket, and wherein the first and second fastener structures are magnetically connectable, and the magnet is positioned above a footprint of the second fastener structure with the recessed surface interfacing between the second fastener and the magnet when the second fastener is in a connected position with the first fastener structure;

at least a third fastener structure is removably connectable to the at least one of the male friction-snap fastener or the female friction-snap fastener positioned on the first side of the first fastener structure; and at least two securable articles, wherein a first securable article of the at least two securable articles is positioned in contact with the third fastener, and wherein a second securable article of the at least two securable articles is positioned in contact with one of the first fastener structure or the second fastener structure, wherein the first fastener structure, the second fastener structure, and the third fastener structure form a magnetically removable connection between the first and second securable articles.

14. The magnetic fastener system of claim 13, further comprising a bonding structure positioned within the pocket and substantially covering at least one side of the magnet, wherein the bonding structure retains the magnet within the pocket.

15. The magnetic fastener system of claim 14, wherein the bonding structure further comprises a substantially planar disk formed from metal or plastic, wherein the recessed surface is formed on one side of the substantially planar disk.

16. The magnetic fastener system of claim 15, further comprising a wall cavity formed in an interior sidewall surface of the captive wall, wherein the substantially planar disk is positioned at least partially within the wall cavity, wherein a terminating circular edge of the substantially planar disk is positioned interior of the interior sidewall surface of the captive wall.

17. The magnetic fastener system of claim 14, wherein the third fastener structure further comprises an enlarged-diameter fastener structure, wherein a diameter of the enlarged-diameter fastener structure at a largest point thereof, is greater than a diameter of the first fastener structure and the second fastener structure.

18. The magnetic fastener system of claim 17, wherein the enlarged-diameter fastener structure has a first side and a second side, wherein the first side is opposite the second side, wherein at least one of a male friction-snap fastener or female friction-snap fastener positioned on the first side and is engageable with the first fastener structure or the second fastener structure, wherein the second side of the enlarged-diameter fastener structure has a smoothed surface.

19. The magnetic fastener system of claim 18, further comprising a cushion disk positioned between the first side of the enlarged-diameter fastener structure and the first fastener structure or the second fastener structure fastener structure.

20. The magnetic fastener system of claim 19, wherein the cushion disk has a diameter which substantially matches the diameter of the enlarged-diameter fastener structure.

* * * * *